US012594455B2

(12) United States Patent
Alaniz, III

(10) Patent No.: US 12,594,455 B2
(45) Date of Patent: Apr. 7, 2026

(54) ELASTIC SUPPORT DEVICE AND OPTIONAL POWER SHIRT AND METHOD OF USE THEREOF

(71) Applicant: Pedro M. Alaniz, III, Corpus Christi, TX (US)

(72) Inventor: Pedro M. Alaniz, III, Corpus Christi, TX (US)

( * ) Notice: Subject to any disclaimer, the term of this patent is extended or adjusted under 35 U.S.C. 154(b) by 182 days.

(21) Appl. No.: 18/384,533

(22) Filed: Oct. 27, 2023

(65) Prior Publication Data

US 2024/0138492 A1 May 2, 2024

Related U.S. Application Data

(60) Provisional application No. 63/420,354, filed on Oct. 28, 2022.

(51) Int. Cl.
*A63B 21/00* (2006.01)
*A41D 13/00* (2006.01)

(52) U.S. Cl.
CPC ..... *A63B 21/40* (2015.10); *A41D 13/0015* (2013.01); *A63B 21/00065* (2013.01); *A63B 2244/09* (2013.01)

(58) Field of Classification Search
CPC ..... A63B 21/065; A63B 21/00
See application file for complete search history.

(56) References Cited

U.S. PATENT DOCUMENTS 1,656,145 A 1/1928 Davis
2,456,190 A 12/1948 Heilbronner
2,808,267 A 10/1957 Heaton
3,324,851 A 6/1967 Posner
4,273,328 A 6/1981 Ozbey et al.
4,473,908 A 10/1984 Knecht
4,570,929 A 2/1986 Shoemaker
4,799,675 A 1/1989 Helmer
4,800,593 A 1/1989 Ruffner
4,890,841 A 1/1990 Brooks
5,383,235 A 1/1995 Peters et al.
5,573,487 A 11/1996 Wallner
5,915,531 A 6/1999 Hilpert et al.
5,978,966 A 11/1999 Dicker et al.
6,047,406 A 4/2000 Dicker et al.
6,061,832 A 5/2000 Morrison, Jr.
6,176,816 B1 1/2001 Dicker et al.
6,231,488 B1 5/2001 Dicker et al.
6,616,581 B2 9/2003 Gwyn
(Continued)

*Primary Examiner* — Nyca T Nguyen

(74) *Attorney, Agent, or Firm* — M. Susan Spiering; Ochoa & Associates, P.C.

(57) ABSTRACT

Disclosed is a modular elastic support device including a base unit and at least one modular unit used for enhancing performance during weight training, or resistance training. The base unit and the modular unit include a substantially rectangular shaped chest band, and two arm cuffs at either end of the chest band. The modular unit is stacked over the base unit, or over preceding modular units. A user can add any number of modular units as desired to enhance performance. The modular design of the device allows for device formation, without the need to sew successive units together or without the use of fasteners. An optional power shirt may be used along with the device to further enhance the user's performance.

16 Claims, 10 Drawing Sheets

(56) References Cited

U.S. PATENT DOCUMENTS

| | | | | |
|---|---|---|---|---|
| 6,892,396 | B2 | 5/2005 | Uno et al. | |
| 8,578,517 | B2 | 11/2013 | Alaniz et al. | |
| 8,771,155 | B1 * | 7/2014 | Bell | A63B 21/0428 482/125 |
| D748,209 | S | 1/2016 | Alaniz, II | |
| 9,265,983 | B1 | 2/2016 | Bell | |
| 10,363,452 | B2 | 7/2019 | Alaniz, II | |
| 10,405,589 | B1 * | 9/2019 | Womack | A63B 21/4017 |
| D908,969 | S * | 1/2021 | Forell | D29/101.3 |
| 10,953,276 | B2 | 3/2021 | Alaniz, II | |
| D922,688 | S * | 6/2021 | Forell | D29/101.3 |
| 11,305,147 | B1 * | 4/2022 | Womack | A63B 69/0059 |
| 11,497,259 | B1 * | 11/2022 | Womack | A63B 21/4025 |
| 11,534,645 | B2 * | 12/2022 | Forell | A41D 27/06 |
| 12,083,374 | B1 * | 9/2024 | Womack | A63B 21/4005 |
| 2007/0000015 | A1 | 1/2007 | Alaniz et al. | |
| 2008/0214330 | A1 | 9/2008 | Goebel | |
| 2008/0214331 | A1 | 9/2008 | Goebel | |
| 2015/0196072 | A1 * | 7/2015 | Inzer | A63B 21/00181 2/69 |
| 2017/0232290 | A1 * | 8/2017 | Alaniz, III | A41D 31/18 482/124 |
| 2018/0263303 | A1 * | 9/2018 | Alaniz, III | A41D 31/18 |
| 2019/0275370 | A1 * | 9/2019 | Alaniz, III | A63B 21/4017 |
| 2021/0219633 | A1 * | 7/2021 | Forell | A63B 21/0552 |

* cited by examiner

ELASTIC SUPPORT DEVICE AND OPTIONAL POWER SHIRT AND METHOD OF USE THEREOF

CROSS-REFERENCE TO RELATED APPLICATIONS

This patent application claims priority to, and the benefit of US Provisional Application No. 63/420,354, filed Oct. 28, 2022, the contents of which are hereby incorporated herein by reference in its entirety.

FIELD OF THE DISCLOSURE

The present disclosure relates generally to weightlifting accessories used by power lifters in the power lifting industry, and more particularly to a modular elastic support device spanning the chest of a user to exercise their chest and arms, and an optional garment to overlay the modular elastic support device for increasing the weightlifting capacity of the user. The modular elastic support device is also considered a performance device useful for competitive weightlifting. The disclosure also relates to a method of use thereof.

BACKGROUND

Disclosed herein is an improvement over U.S. Pat. Nos. 10,363,452 and 10,953,276, both patents incorporated by reference in their entirety.

There are several chest and arm exercising devices that incorporate cuffs receiving the arms of a user and an elastic band connecting the cuffs and extending across the chest. These devices are used when doing push-ups, lifting weights on a bench press, overhead presses, incline and decline presses, and triceps dips. Typical devices are shown in U.S. Pat. Nos. D748,209, 4,273,328, 4,570,929, 5,573,487, 8,771,155, and 9,265,983 and U.S. Patent Application 2008/0214330. Other U.S. patents of interest include U.S. Pat. Nos. 2,808,267; 3,324,851; 4,799,675; 4,890,841 and 6,616,581.

Weightlifting, much like all sports, hinges on minute performance differentials that distinguish victory from defeat, especially at the highest levels of competition. The rationale behind this phenomenon is the typically closely matched skill levels of competitors. To gain a competitive edge, snug-fitting weightlifter's shirts have been innovatively designed to harness energy when lowering a weight, aiding the lifter in its subsequent ascent, as exemplified in U.S. Pat. No. 4,473,908. This strategy involves angling the sleeves of the lifter's shirt horizontally, allowing the fabric across the chest to stretch during the weight's descent, thereby bolstering the lifter's force when raising it.

Powerlifters and weightlifters participating in internationally sanctioned events must contend with significant constraints, as the governing international associations prefer to restrict or minimize the influence of devices or garments on lifter performance. In essence, although it is feasible to create devices and garments that could significantly enhance a lifter's performance, they must conform to international rules and regulations set forth by organizations such as the International Powerlifting Federation, the General Association of International Sports Federations, and the International Olympic Committee. Conversely, the International Powerlifting Federation is equally concerned with ensuring that these devices or garments do not pose injury risks to lifters. The International Powerlifting Federation has established guidelines pertaining to the types of fabric and yarn permissible in sanctioned lifting events. In unlimited lifting events, where rules are essentially non-existent, support devices and garments can be crafted using any fabric and construction method.

Some governing bodies within the lifting community now permit the use of devices and garments that explicitly serve to store energy, thereby enhancing lifters' ability to raise weights. Notable mentions in this context include the following U.S. patents: U.S. Pat. Nos. 1,656,145; 2,456,190; 4,800,593; 5,383,235; 5,915,531; and 6,061,832.

Information regarding weightlifting shirts can be found in U.S. Pat. Nos. 4,473,908; 5,978,966; 6,047,406; 6,176,816; 6,231,488; and 6,892,396, as well as U.S. Design Pat. No. 748,209 and U.S. Patent Application 20070000015. Furthermore, the following references also shed light on weightlifting shirts: U.S. Pat. No. 10,405,589; USD908969S1; USD922688S1; and US20210219633A1.

Despite the wealth of information available to date, a persistent demand exists for enhanced weightlifting support devices aimed at targeting the chest and arm areas of users, as well as performance-enhancing tools for competitive weightlifters, along with corresponding apparel and accessories for powerlifting and resistance training in competitive settings.

SUMMARY

Disclosed herein is a modular elastic support device for users who lift weights or do weight training exercises. The modular design of the modular elastic support device allows for combining modular units for improved performance as per the user's requirement. In accordance with embodiments of the present disclosure, a modular elastic support device is provided. The modular elastic support device includes a base unit and at least one (1) modular unit. One version consists of a base unit consisting of a rectangular shaped chest band that is comprised of a first rubber or elastic sheet having a left side, a right side, a top side, and a bottom side. The base unit further includes a base left arm cuff and a base right arm cuff which are made from a second rubber or elastic sheet. The base left arm cuff and the base right arm cuff are secured substantially perpendicular to the base chest band. An alternate version is comprised of a heavy elastic having a rubber count at least in a range of about 200 to 250 strands per 3" width. The base left arm cuff and the base right arm cuff are secured by means of gussets provided on the left side and the right side of the base chest band. The gussets comprise a 100% warp knit polyester fabric with a minimum weight of 5.9, preferably 14 oz/yd or greater.

The base unit further includes an abdomen band or panel that comprises a third rubber or elastic sheet. The abdomen band is centered on the base chest band, substantially perpendicular to the chest band, and secured by a gusset on the bottom side of the base chest band. Alternatively, the abdomen panel is sewn directly onto the lower portion of the chest panel. The modular elastic support device also includes at least one modular unit; the modular unit being a different piece than the base unit. Multiple modular units may be employed with the base unit, with up to 4 units shown herein for a 5-ply unit (base+4 units). The modular unit comprises all components similar to the base unit, however the arm cuffs are slightly larger to nest or stack over the prior arm cuff, providing essentially a zero gap between arm cuffs. There is also no need for an abdomen panel in the modular unit(s) as the base unit contains the abdomen panel for the user. The modular unit comprises its own first rubber or elastic sheet having a left side, a right side, a top side and a bottom side; its own left arm cuff and a modular right arm cuff that each are made from a second rubber or elastic sheet, and the arm cuffs are attached or secured to the chest panel by means of gussets provided on the left side and the right side of the modular chest band. The modular left and right arm cuffs nest or stack over the base unit to form the performance enhancing modular elastic support device.

The arm cuffs of the base and modular units are essentially circular and secured onto the chest band at about a 90-degree angle relative to the chest band. An alternate embodiment comprises the arm cuffs being in a tapered arrangement and secured to the chest band at about a 70 degree angle relative to the chest band. In both versions the outside, tricep portion of the sleeve remains at a 90° angle. Each embodiment involves stacking of the arm cuffs to produce the performance enhancing support device.

In yet another embodiment of the disclosure, an optional power shirt is provided to be worn over the support device for additional power enhancement during weight training and/or lifting.

BRIEF DESCRIPTION OF THE DRAWINGS

The accompanying drawings illustrate the various embodiments of the disclosure and methods of design, manufacture, use and other aspects of the disclosure. It will be apparent to a person skilled in the art that the illustrated elements in the figures represent one example of the boundaries. In some examples, one element may be designed as multiple elements, or multiple elements may be designed as one element. In some examples, an element shown as an internal component of one element may be implemented as an external component in another, and vice versa.

Various embodiments of the present disclosure are illustrated by way of example, and are not limited by the appended figures, in which like references indicate similar elements, and in which.

DETAILED DESCRIPTION

Figure 1:
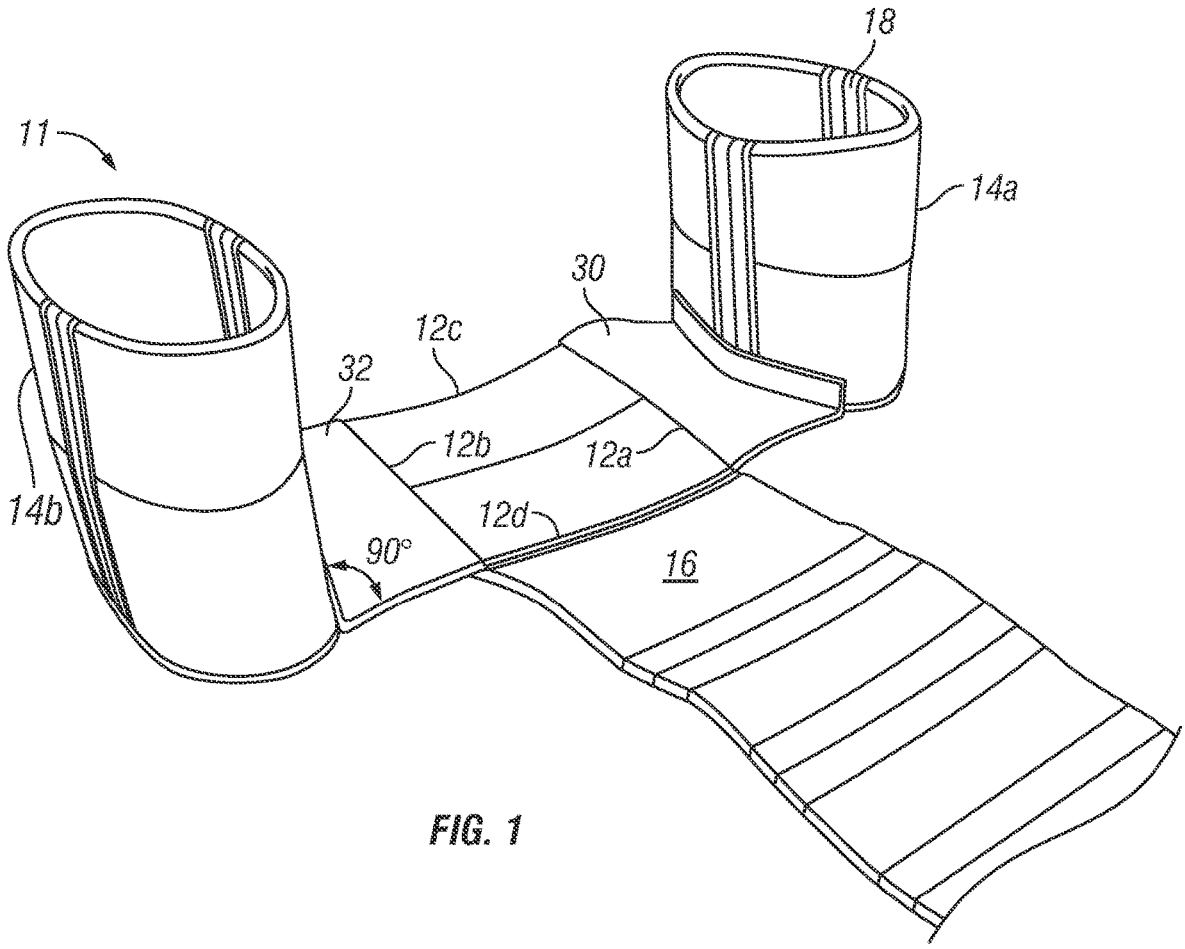
FIG. 1 is a top view of a base unit of a modular elastic support device, according to various embodiments of the present disclosure.

As used in the specification and claims, the singular forms "a", "an" and "the" include plural references unless the context clearly dictates otherwise. For example, the term "an article" may include a plurality of articles unless the context clearly dictates otherwise.

Those with ordinary skill in the art will appreciate that the elements in the Figures are illustrated for simplicity and clarity and are not necessarily drawn to scale. For example, the dimensions of some of the elements in the Figures may be exaggerated, relative to other elements, in order to improve the understanding of the present disclosure.

There may be additional components described in the foregoing application that are not depicted on one of the described drawings. In the event such a component is described, but not depicted in a drawing, the absence of such a drawing should not be considered as an omission of such design from the specification.

As required, detailed embodiments of the present disclosure are disclosed herein; however, it is to be understood that the disclosed embodiments are merely exemplary of the disclosure, which can be embodied in various forms. Therefore, specific structural and functional details disclosed herein are not to be interpreted as limiting, but merely as a basis for the claims and as a representative basis for teaching one skilled in the art to variously employ the present disclosure in virtually any appropriately detailed structure. Further, the terms and phrases used herein are not intended to be limiting but rather to provide an understandable description of the disclosure.

The terms "device" and "modular elastic support device" are interchangeably used herein, and refers to the inventive device having a base unit including a chest band with arm cuffs together with an abdomen panel or band, and is combined with at least one modular unit. The base unit may also be otherwise referred to as a "base device". The term "chest band" is interchangeably termed "elastic member".

The terms "multiple devices" and "assembly" as used herein corresponds to the at least one modular unit that is combined with the base unit. The assembly or multiple devices are formed by overlaying the at least one modular unit with the base unit. The base unit may be referred to as a "single ply" or "single layer or "layer". The base unit along with the at least one modular unit constituting the device may be termed as "modular elastic support device", "multiple ply device", "multiple layered device" or may be termed as per the number of layers as two-ply (2-ply) device or two-layer (2-layer) device.

The terms "user", "power lifter", "lifter", "weight lifter" have been interchangeably used herein, and refers to an individual who will be using the device as disclosed by the present disclosure. Further, it will be understood that such a user may be an inexperienced or a seasoned or professional weightlifter aware of using similar such arm and chest exercising devices to enhance performance.

The term "garment" as used herein refers to a "shirt", and includes interchangeably a "compression shirt", a "supportive shirt", or a "power shirt" that is able to store energy and when used along with the device enhances the performance of the user when compared to a shirt used without the inventive device.

As used herein, the terms "power", "energy return", "stored energy", "support" and "strength" are interchangeably used and can be defined as the energy transferred from the device to a user during weight lifting. The terms may also refer to the energy stored in the device, the shirt, or both when used together.

Embodiments of the present disclosure offer a modular elastic support device comprising a base unit and at least one modular unit. The base unit includes a chest band equipped with arm cuffs at each end, and an abdomen panel or abdomen band positioned centrally on the chest band. The at modular unit is similarly constructed but lacks the abdomen band. This support device is engineered to store and release power during its use, hence enhance a user's performance. The arm cuffs are firmly secured at a substantially perpendicular angle to the chest band. In an alternative embodiment, the inner edges of the arm cuffs are at about a 70 degree angle relative to the chest band. The abdomen band lies on the same plane as the chest band and, when in use, lies flat on the user's abdomen, as does the chest band. The arm cuffs are sufficiently rigid to stand upright on their own, and when multiple devices are layered on top of each other, the arm cuffs become even stiffer. The assembly or modular elastic support device lies next to the user's skin. Assembly, or overlaying of multiple plies or layers, enables the user to adjust the amount of stored power or strength within the device. Each layer is considered 1 ply of strength; thus, with 2 layers, the device is considered 2 plies (see FIG. 4), and with 3 layers, it is considered 3 plies, and so on. The user can combine as many layers as they desire, but it is important to note that as more layers are added, the device becomes bulkier, and the user will experience increased resistance. It has been found that 3-5 layers or 3-5 ply strength is sufficient for supporting and maximizing the user's ability to lift weights. After reaching the maximum, any remaining strength is stored in the device, and not utilized on meet-day when the user attempts an absolute maximum lift.

The objective of progressive strength training is always to prepare the power lifter for improved performance at the next event. Through proper training, which may include overload training (i.e., assisted lifting with weights exceeding the lifter's maximum), it is possible for the lifter to add an optional shirt layer and lift more weight at the next event. It is estimated that each layer provides a minimum force increase of about 83 lbs. to the user.

The enhancement in energy storage of the inventive device, compared to existing devices, is attributed to two factors: the design or architecture of the device (including the stacking capability to adjust power) and the elastic nature of the materials used in its construction. The design of the chest band with sleeves or arm cuffs substantially perpendicular to the chest band has proven to be an efficient design for storing and returning energy when using stretchable fabrics/materials. In an alternate design, tapered arm cuffs have also shown to be an efficient design for storing and returning energy. Additionally, the tapered arm cuffs have been found to reduce pinch points that may harm the user. Static fabrics that do not stretch do a poor job of storing energy. The elastic properties of the materials used in the device's design and construction allow the chest band and arm cuffs to provide resistance during the eccentric (stretching) phase when the power lifter lowers the bar to the chest. This resistance, unlike static materials, does not dissipate but rather mimics the stretch of muscles, storing energy for the concentric (lifting) phase of the lift. As the bar reaches the power lifter's chest and the lifter begins the concentric phase, the elastic material returns the stored energy as it reverts to its original length, assisting in pushing the bar off the power lifter's chest.

A significant advantage of the device, suitable for weight training or resistance training, is its modular design. The modular design, combining the base unit and at least one modular unit, allows for achieving the required stored energy, power or energy return according to the user's capabilities. The modular design permits the addition of extra layers or units without the need for sewing or joining successive units together. These modular units can be combined by placing one unit over another in the arm cuff area to increase support for the chest/arm area (e.g., with 2 layers, there is 2-ply support). During assembly, each succeeding modular unit is stacked over a preceding modular unit (see FIG. 4 and FIG. 5). The arm cuffs of the succeeding modular unit are slightly larger than arm cuffs of the preceding modular unit for a snug fit so as to provide approximately a zero gap between the cuffs and provide for energy between the modular and base unit to the user to assist during weightlifting. A user can add as many layers or units as desired. The base unit is considered to provide 1 ply of lifting support to the user. If a user can bench-press 600 lbs. without a shirt, it has been found that the device can allow him to bench-press at least or greater than 1,100 lbs. which is equivalent to about 183% energy return. It is to be noted that the energy return is not static. The energy return is dependent on several variables including the user's raw strength, leverages, muscle mass, and fit. The greater raw strength will provide greater potential energy storage and higher energy return. A shorter limb length of the user increases leverages and potential to lift more weight and hence higher energy return. An increase in muscle mass enhances leverages as well as providing more fast twitch muscle fiber to exert more force. A tighter fit of the device will produce more energy storage potential. In short, a user with a high level of raw strength, shorter arms for increased leverage, with a tight-fitting device will get more energy return than a user with a lower level of strength, longer arms, less mass and a looser fit.

The ability to combine layers enables the user to precisely adjust the amount of stored energy or energy return desired for use during weightlifting. In general, it has been found that combining 3-5 layers with a power shirt provides sufficient power storage for maximum power and weightlifting performance by a user. The use of the modular-designed chest/arm unit with the power shirt has been found to increase the user's power lifting capacity by at least 20%, and in some cases, up to 50% or more. Similar to the original chest/arm device as disclosed in U.S. Pat. No. 10,953,276 (US'276), the inventive device does not place stress on the user's rotator cuff and utilizes the body's natural movements, making it biomechanically oriented and designed.

The prior art device of US '276 could not be combined with additional layers, unlike the present disclosure. The improved inventive device is designed slightly larger in the cuff area to accommodate these multiple layers. It has been observed that each additional layer is only slightly larger than the previous one, ensuring a snug fit. When combined, it is important that the seams of the arm cuffs align for optimal power storage, distribution, and dissipation, as well as to prevent the individual devices from shifting during use. Aligning the seams not only improves comfort for the user but also ensures the desired support during device use. It was unexpected that the additional layers of the device, when stacked, were able to store and transfer energy in a coordinated manner, with each layer adding to the storage and energy transfer capabilities, without creating excessive bulk that would hinder the user's ability to lift weights or function effectively.

The inventive device and optional shirt utilize a combination of resistance, compression, and aided anatomical leverages to achieve their performance enhancing energy storage and release properties, enhancing the power lifter or user's ability to lift weights and handle heavier loads. The present device can be used with training and exercise equipment that simulates free weights, and it is suitable for use in chain fitness centers, as well as many high school and university gyms. Additionally, other applications for the arm/chest device and shirt will be discussed, and those skilled in the art may envision alternate embodiments or applications.

The optional shirt for use by weightlifters disclosed, comprises front, back, and sleeve regions. The shirt is devoid of elastic bands and can be constructed from spandex (for maximum stretch and minimal power), polyester (double knit for additional power or warp knit for maximum), or a combination thereof. Regarding the modular elastic support device, the shirt is not physically connected to the device but is worn over it. While not as effective as the modular elastic support device, the shirt also provides support and energy to the weightlifter. When worn over the device, the user will experience additional stored energy during weightlifting exercises. The chest and sleeves of the shirt are made of warp knit polyester fabric, so during a bench press lift, lowering a weighted bar causes the fabric to stretch, storing energy in the fabric and assisting the lifter in raising the bar. The shirt is placed over the device, and optionally, a weightlifting belt is fastened around the user's waist to secure both the device and shirt in place.

Referring to FIG. 1, a modular elastic support device 10 for a user is shown. The modular elastic support device has a base unit 11 as shown. The base unit 11 includes an substantially rectangular shaped elastic member 12 or a base chest band 12 connected to a base right arm cuff 14*a* and a base left arm cuff 14*b*. The base arm cuffs, namely the base right arm cuff 14*a* and the base left arm cuff 14*b*, are secured substantially perpendicular, or at about 90 degrees, to the base chest band 12. The base arm cuffs, the base right arm cuff 14*a* and the base left arm cuff 14*b* may otherwise be collectively termed as "arm cuffs". An abdomen band 16 extends downward and is centered on the base chest band 12, substantially perpendicular to the chest panel (or band). An alternative version consists of an abdomen panel composed of 100% warp knit polyester material with a minimum weight of 5.9 preferably, 14 oz/yd.

Figure 2:
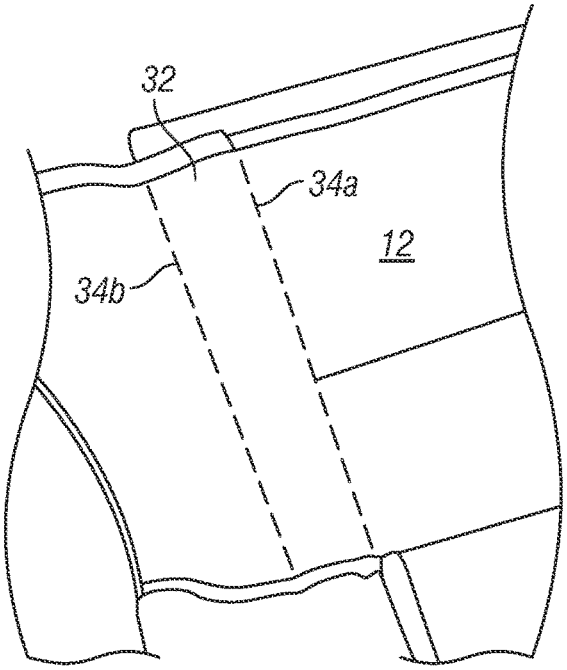
FIG. 2 illustrates a gusset between an arm cuff and a chest band, with seams exposed, of the modular elastic support device, according to various embodiments of the present disclosure.

FIG. 2 illustrates the gusset used to secure the arm cuff to the chest band. See seams 34*a* and *b* shown to provide additional security to the device. More details on the gussets follow herein.

FIGS. 3A, 3B, 13 and 14 show an exemplary alternate modular elastic support device 20, having angled tapered arm cuffs Similar to device 11, the modular elastic support device 20 includes a base unit 21 that includes a substantially rectangular shaped base chest band 22. The base chest band 22 is connected to a base right arm cuff 24*a* and a base left arm cuff 24*b*. The base right arm cuff 24*a* and the base left arm cuff 24*b* are hereinafter referred to as "base arm cuffs". An outer edge 28*a* of the base right arm cuff 24*a* and an outer edge 28*b* of the base left arm cuff 24*b* are secured at about a 90-degree angle on the outer edge relative to the user. An optional abdomen band may extend downward and may be centered on the base chest band 22, substantially perpendicular to the chest band. The modular elastic support device 20 differs from modular elastic support device 10, in one instance, in that the base arm cuffs 24*a* and 24*b* are angled or tapered. The angling or tapering of the base arm cuffs 24*a* and 24*b* advantageously enhances the fit of the modular elastic support device 20 from the shoulder girdle of the user to the end of the bicep when compared to the modular elastic support device 10. The enhanced fit or a tighter fit is more effective at storing energy than a looser fit.

Figure 3A:
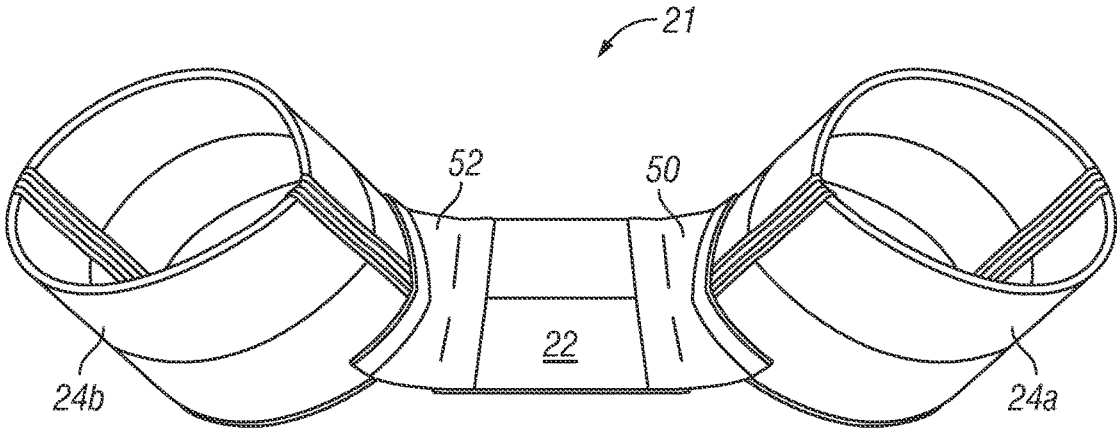
FIG. 3A illustrates a top view of a modular unit having angled tapered arm cuffs, according to yet another embodiment of the present disclosure.
Figure 3B:
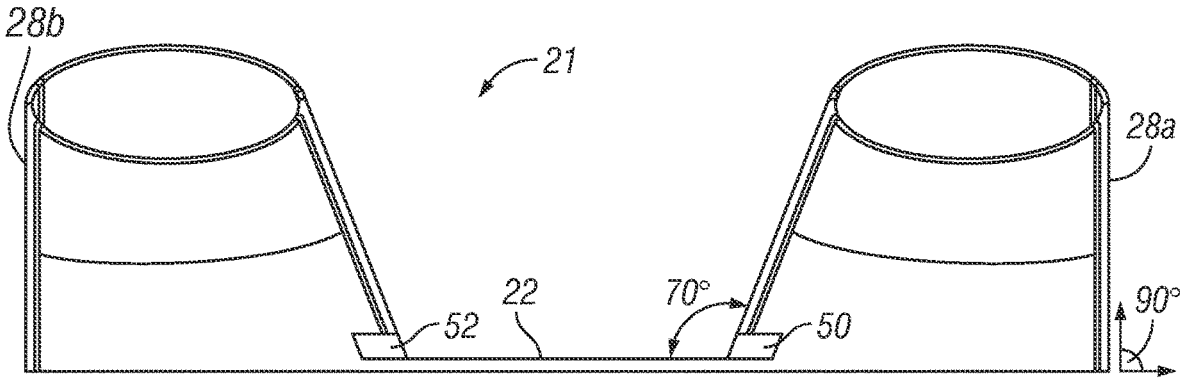
FIG. 3B illustrates a side view of FIG. 3A.

The base unit as seen in FIG. 1 illustrates the arm cuffs in a substantially perpendicular position for an angle of about 90 degrees relative to the base chest band 22. In FIG. 3A, the angling or tapering of the base arm cuffs on the inside (closest to the chest panel) 24*a* and 24*b* at about a 70-degree angle, is achieved by angling the inner edges of the base arm cuffs 24*a* and 24*b* relative to the base chest band 22. The angling or tapering, in addition to providing more energy is also helpful in preventing pinch points that may hurt the user. It has been observed that tapering the base arm cuffs on the outside/triceps brachii portion of the sleeve creates a pinch point where the latissimus dorsi meets the top of the triceps brachii of the user. The modular elastic support device 20 stores energy in the base chest band 22 when a weight is lowered and then expends energy when the weight is raised. When the weight is lowered, the arm cuffs expand and may create a point that painfully digs into the user, and this may be avoided by tapering the arm cuffs on the inside of the sleeve (closest to the chest panel).

The base chest band 12, 22 the base arm cuffs 14*a*, 14*b*, 24*a*, 24*b* and abdomen band 16 independent of each other, may include a composite structure including an elastic or a rubber or rubber-like sheet. The composite structure may be made of an impermeable rubber or rubber-like sheet encased or partially encased in a fabric. Examples of such fabric include, but are not limited to, nylon and polyester. The rubber or rubber-like sheet provides the elastic characteristics while the fabric provides reduced frictional contact between the modular elastic support device 10 or 20 and the user's body.

In another exemplary embodiment, the composite structure includes fabric layered over elastic. The lamination of the fabric over the elastic is accomplished using an adhesive, such as a thermoplastic polyurethane (TPU) hot melt adhesive. To prevent any separation between the layers, namely the elastic and the fabric, the edges of these layers may be securely stitched together using an appropriate stitching technique. An example of such a stitching technique is the use of a serger stitch. Additionally, a tight zig-zag stitch can be applied both along and across the layers for added reinforcement. Besides the stitch pattern, the choice of thread is equally essential for preserving the integrity and durability of the modular elastic support device 10 and 20, while also providing maximum tensile strength. In one embodiment, the thread utilized is polyamide 6.6 continuous filament, bonded thread.

The material composing the elastic sheet may encompass a range of natural or synthetic rubber types suitable for the intended application. For the purposes of this disclosure, "rubber or elastic" is used as a broad term that includes rubber, latex, polymer and similar materials that share rubber-like properties. One such suitable type is presently commercially available from The Hygenic Corp. located in Akron, Ohio. These latex or rubber sheets typically possess an impermeable nature, featuring a smooth exterior surface that is especially conducive to receiving graphics. These graphics can be applied through methods such as printing, silk screening, or other applicable techniques. In this context, "impermeable" signifies that the material resists penetration, even though there may be minor, inconsequential openings within it.

The elasticity or resistance of the rubber sheet can vary significantly based on the physical capabilities of the intended user. For exercise devices designed for women and children, the rubber sheet may exhibit considerably higher elasticity or lower resistance compared to those intended for adult men. Moreover, the level of resistance in devices for adult men may differ significantly depending on the specific physical strength of the intended user.

For the purpose of this disclosure, the term "sheet" refers to an object possessing width, length, and thickness, where either the width or length is at least ten times the thickness. Preferably, this ratio may be twenty times the thickness, and in some ideal cases, it may be even greater, for instance, up to thirty times the thickness.

In one embodiment, the base chest band 12, 22 is constructed using a first rubber or elastic sheet. This first rubber sheet is designed with distinct right (12*a*) and left (12*b*) sides, a top side (12*c*), and a bottom side (12*d*), as illustrated in FIG. 1. For the purposes of this disclosure, the term "first rubber sheet" corresponds to a composite structure as previously described, which may include a fabric component. Properties of the rubber sheet comprise elasticity in the longitudinal dimension and little to no stretch in the transverse dimension.

The resistance characteristics of the base chest band 12 and 22 are influenced by various factors, including the width, length, thickness, and the material's inherent strength within the first elastic sheet. The appropriate selection of these parameters, such as thickness, material properties, width, and length, collaboratively determine the desired resistance to stretching for the modular elastic support device 10 and 20.

Typically, the elastic sheets used comprise three-inch (3") pieces sewn together to form the desired elastic sheet dimensions for use on the chest panel, abdomen panel and arm cuffs.

In one embodiment, the base chest band 12, 22 is a single piece of the first elastic sheet having desired dimensions. One effective combination of thickness, length, and width, considering commercially available materials, consists of a width of approximately 15 centimeters (cm) or 5.9 inches (5.9"), a thickness of 4.5 millimeters (mm) or 0.177 inches, and a length proportionate to the user's size. This combination results in a first elastic sheet with an elongation of approximately 25% when subjected to an eighty-pound tension and an elongation of about 50% when under one hundred and forty pounds of tension. These measurements are applicable longitudinally, between the base arm cuffs 14*a* and 14*b*.

In another embodiment, a suitable first elastic sheet with dimensions of about centimeters in width, 4.5 millimeters in thickness, and a length of 24 centimeters exhibited a stretch of approximately 3 inches (approximately 7.62 centimeters), which is roughly 32% of its initial length. It is evident that there can be significant variation in the resistance of the base chest band 12 and 22. A typical range of resistances, accommodating adult men of varying capacities, women with different strength levels, and children with differing abilities, would typically fall within a range of about 25% elongation at tensions ranging from 50 to 150 pounds and 50% elongation at tensions between 100 and 175 pounds.

Alternatively, the base chest band 12, 22 may be made from a first rubber or elastic sheet formed by combining multiple pieces of composite structure. In one embodiment, the chest band 12, 22 is formed by combining two 3" pieces of elastic material to form a 6" piece of the first rubber or elastic sheet. The multiple pieces of composite structure are butt-sewn together.

The base right arm cuffs 14*a* and 24*a*, as well as the base left arm cuffs 14*b* and 24*b*, incorporate a second rubber or elastic sheet (not depicted). In the context of this document, the term "second rubber or elastic sheet" corresponds to a composite structure, as previously described, which may also contain a fabric component. As depicted in FIG. 1 and FIGS. 3A and B, the base arm cuffs 14*a*, 14*b*, 24*a*, and 24*b* can be constructed using this second elastic sheet and then shaped into a circular form. It is evident that there can be considerable variation in the thickness, width, and material composition to achieve the desired resistance for the movement of these base arm cuffs 14*a*, 14*b*, 24*a*, and 24*b*. The second elastic sheet can be a single composite structure. Alternately, multiple composite structures of about 3" pieces are joined together to form the second elastic sheet. Each composite structure may be of 3" in dimensions and as many pieces may be joined together to form the base arm cuffs 14*a*, 14*b*, 24*a*, and 24*b* of desired dimension. The joining of the multiple composite structures are accomplished by butt-sewing them together.

Generally, the thickness of the second elastic sheet can fall within the range of approximately one-tenth (1/10) to about three-eighths (3/8) inch, providing substantial resistance to the separation or spreading of the base arm cuffs 14*a*, 14*b*, 24*a*, and 24*b* from each other. The width of the second elastic sheet may vary between approximately two (2) inches and ten (10) inches, with most variations accommodating the size of the user. The length of the second elastic sheet depends on the specific dimensions of the individual for whom the modular elastic support device 10 and 20 is tailored, ranging from about approximately 4 inches (approximately 10 centimeters) to approximately 13 inches (approximately 33 centimeters). The second elastic sheet may possess surface characteristics that, under certain circumstances, could lead to undesirable friction or irritation when in contact with the user's skin, even if the user is wearing clothing underneath the device 10 and 20. This friction can be unpredictable and potentially compromise the user's form. The construction of the disclosed modular elastic support device 10 and 20 ensures that it operates effectively, regardless of the user's attire, whether wearing a shirt or even when bare-chested. While recommended to use the device next to the skin, it may be used over clothing, recognizing energy transfer may be impacted.

The base right arm cuff 14*a* and the base left arm cuff 14*b*, both made of the second elastic sheet, are securely attached substantially perpendicular to the base chest band 12, as demonstrated in FIG. 1. In certain embodiments where the second elastic sheet is thin enough to be overlapped and sewn together, the ends of the second rubber sheet may overlap and be sewn, a common technique in the industry, (but sewing doesn't involve overlapping). When dealing with thicker second rubber sheet materials, it is preferable for the ends of the second rubber sheet to abut, rather than overlap, and be joined together in a suitable manner.

Referring to FIGS. 1-2, gussets 30 and 32 are affixed to the right side 12*a* and the left side 12*b*, respectively, of the base chest band 12, as depicted. The gussets 30 and 32 are connected to the edge of the base right arm cuff 14*a* and the base left arm cuff 14*b*, respectively, and then extended to connect with the right side 12*a* and the left side 12*b* of the base chest band 12. In one embodiment, the gusset 32 is sewn along lines 34*a* and 34*b*, as indicated in FIG. 2. As shown, gussets 30 and 32 are shaped to match a shape of the base right arm cuff 14*a* and the base left arm cuff 14*b* at a site of their attachment. It is important to note that gussets are utilized for the modular elastic support device 10 but are not incorporated into the optional power shirt overlay.

Figure 10A:
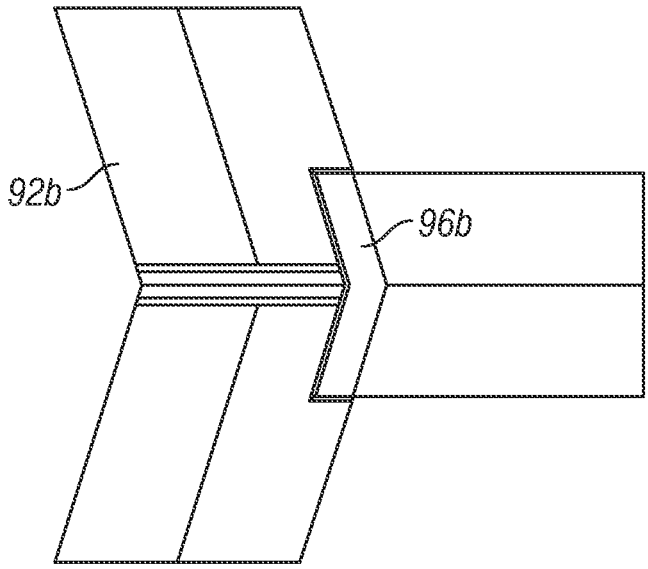
FIGS. 10A and 10B illustrate the cut out pattern design for use for the angled tapered arm cuffs design and gussets according to various embodiments of the present disclosure.
Figure 10B:
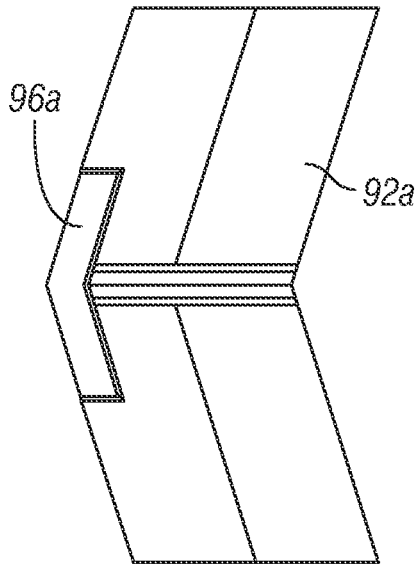

In FIG. 3A, gusset 50 is attached to the center of the base right arm cuff 24*a* before being attached to the right side of the base chest band 22. Unlike the gussets 30 and 32, the gussets 50 and 52 are shaped in a manner that results in a tapered configuration for the base arm cuffs 24*a* and 24*b*. A more detailed view of the gussets 50 and 52 is provided in FIGS. 10A and B, and FIG. 15.

The base chest band 12 and 22, as well as the base arm cuffs 14*a*, 14*b*, 24*a*, and 24*b*, are joined through stitching. Consequently, when the user moves their arms towards the rear, the base arm cuffs 14*a*, 14*b*, 24*a*, and 24*b* stretch the base chest band 12 and 22 and arm cuffs, storing energy within it. Conversely, moving the user's arms forward allows the base chest band 12 and 22 to assist in moving the user's arms in that direction. This design of the modular elastic support device 10 and 20 results in the storage of energy within the base chest band 12 and 22 and arm cuffs when a weight is lowered and the expenditure of energy when the weight is raised. The base chest band 12 and 22 and arm cuffs extend across the user's chest and terminates between the user's elbows and shoulder joints. (see FIG. 16).

The gussets play a unique role in this design. The gussets 30, 32, 50, and 52 are crafted from a material or fabric significantly stronger than the base arm cuffs 14*a*, 14*b*, 24*a*, 24*b*, base chest band 12, 22, and abdomen band 16. In one embodiment, the gussets 30, 32, 50, and 52 are constructed from 14 oz warp knit polyester, which possesses limited stretch.

While the primary function of the gussets 30, 32, 50, and 52 is to connect the base arm cuffs 14*a*, 14*b*, 24*a*, and 24*b* to the base chest band 12, 22, they also serve as amplifiers and/or regulators concerning energy storage, output, and overall durability of the device. Although the elastic material used is quite heavy, with a minimum of 5.9 oz per yard or 182 grams per meter in strength, like all elastic materials, it possesses a degree of stretch. However, the specific material choice for the gussets 30, 32, 50, and 52 can restrict the stretch of these gussets. The stretch and energy storage can also be regulated to some extent by adjusting the size of the gussets 30, 32, 50, and 52.

The gussets 30, 32, 50, and 52 can control the stretch, acting as a power brake. As the fabric has stretch properties that are less than the elastic chest panel and sleeves, it limits the degree of total stretch or expansion as compared to using a fabric with similar stretch properties to the elastic chest and sleeves. Without the presence of the gussets 30, 32, 50, and 52, if the base chest band 12, 22 were connected directly to the base arm cuffs 14*a*, 14*b*, 24*a*, and 24*b*, the unit would exhibit considerably more stretch. Among the other functions of the gussets 30, 32, 50, and 52, they effectively limit the amount of stretch, thereby enhancing energy storage and power.

The positioning of the base arm cuffs 14*a* and 14*b* at the periphery of the base chest band 12 allows for optimal strength, power storage, and durability of the device. Stitch line 34*b* represents the location of the seams between the gusset 32 and the arm cuff 14*b*, while seam line 34*a* indicates the location of the seams between the gusset 32 and the base chest band 12, as shown in FIGS. 2 and 3A. Seam lines are also present between pieces of elastic butted together to make the chest band, arm cuffs and abdomen panel. Straight stitching is unsuitable for this construction, as it may fail under stress. Instead, a very tight zig-zag stitch is more appropriate, as it provides a greater number of stitches per square inch, enabling the stitch to flex and distribute stress over a larger stitch area.

The unique design of the gussets 30, 32, 50, and 52 in the base chest band 12 and 22 enables modular stacking of the modular elastic support device 10 and 20. Traditional seams typically involve sewing one layer onto another, doubling the thickness of the joint and resulting in an uneven interior circumference. Modular stacking using this approach would lead to bulky sleeves or arm cuffs and gaps at the joints between successive layers, undermining the device's effectiveness.

The inventive construction of the gussets (30, 32, 50, and 52) facilitates a modular design for the modular elastic support device 10 and 20. The gussets 30, 32, 50, and 52 create virtually flat joint surfaces with a thickness of approximately 1.01 mm. The design for device 10 allows for consistent circumferences throughout the entire arm cuff and/or sleeve (for a shirt) and minimal tolerances, essentially a zero-gap space, between the layers of the modular elastic support device 10 and 20 when stacked or layered. Consequently, the multiple layers of the modular elastic support device 10 and 20 act as a single composite unit during use and do not shift once layered together. The inventive design permits the stacking of modular units without the need for mechanical attachments (e.g., hook and loop, ties) to secure the layers in place.

The fabric and/or material chosen for the gussets 30, 32, 50, and 52 is exceptionally strong, durable, and thin. In one embodiment, the gussets 30, 32, 50, and 52 consist of 100% warp knit polyester with a minimum weight of 5.9 oz/yard up to and greater than 14 oz/yard (36 inches in length by 60 inches in width). These specifications are based on a 2006 report from Osterreichisches Textil-Forschungsinstitut. The gussets 30, 32, 50, and 52, in another embodiment, are composed of a warp knit polyester specially developed for Titan Support Systems, Inc., of Corpus Christi, Texas, by a specialized mill. These gussets are substantially stronger than the first elastic sheet of the base chest band 12, 22, or, the second rubber sheet of the base arm cuffs 14*a*, 14*b*, 24*a*, and 24*b*, or shirt 60.

Additional details on the gussets 30, 32, 50 and 52 of the disclosure are shown in the table 1 below:

TABLE 1

| Material Specification of Gusset | |
|---|---|
| Fabric Data | Warp Knit Polyester |
| thickness mm | 1.01 |
| Mass g/m$^2$ | 485.8 |

TABLE 1-continued

| Material Specification of Gusset | |
|---|---|
| Fabric Data | Warp Knit Polyester |
| Max Force Longitudinal N (Newtons) | 1438.8 |
| Max Force Cross N (Newtons) | 2022.3 |

Figure 9:
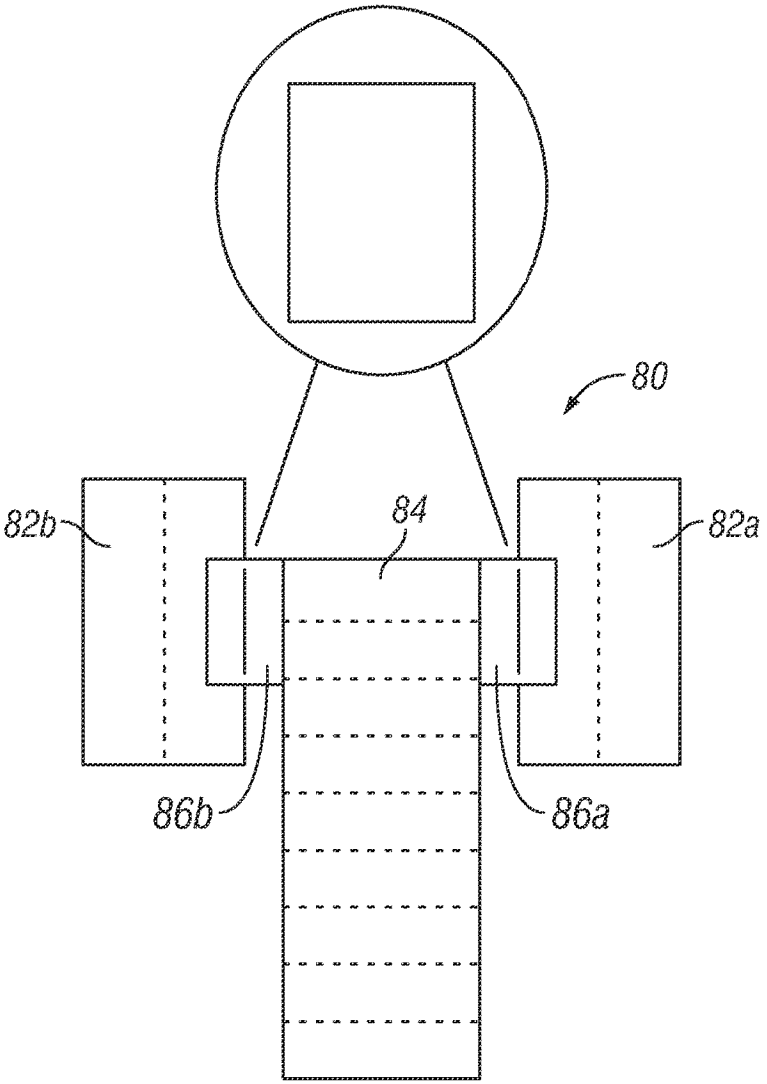
FIG. 9 illustrates the cut out pattern for the base unit having straight arm cuffs with an enlargement of the gusset region according to various embodiments of the present disclosure.
Figure 15:
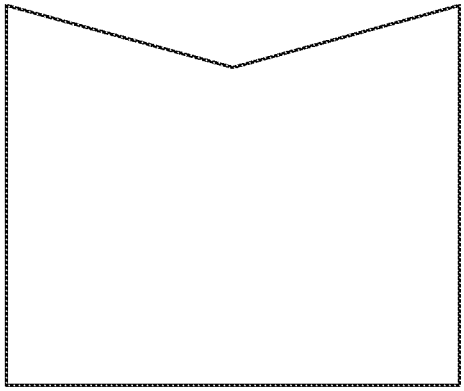
FIG. 15 illustrates a cutout design for the gusset to be used for the angled tapered arm cuff.

FIG. 9 illustrates an embodiment of the construction of a base unit 80 using gussets 86*a* and 86*b*. These gussets, each measuring 4 inches in width and 6 inches in height, are employed to attach a base chest band 84 to a right arm cuff 82*a* and a left arm cuff 82*b*. To achieve this connection, gussets 86*a* and 86*b* are sewn onto each end of the base chest band 84 with approximately a 1-inch overlap. The opposite ends of gussets 86*a* and 86*b* are then sewn onto a base end of the right arm cuff 82*a* and a base end of the left arm cuff 82*b*, again with a 1-inch overlap. As a result, about a 2-inch wide by 6-inch-tall section of the gussets 86*a* and 86*b* remains unattached and free. The gusset for alternate tapered arm cuff design 21 is seen in FIG. 15, where opposite ends are shaped to match a shape of the base ends of the right arm cuff 24*a* and the left arm cuff 24*b* of the tapered arm cuff design. In the embodiment of FIG. 1, the gussets 30 and 32 are rectangular in shape to match the shape of the base ends of the right arm cuff 14*a* and the left arm cuff 14*b*. The gussets 86*a* and 86*b* underwent failure analysis testing, with results indicating forces of 1438.8 newtons in the longitudinal direction and 2022.3 newtons in the cross direction. The inset of FIG. 9 provides an enlarged view of gussets 86*a* and 86*b*, illustrating their 4-inch width that supports the arm cuff and chest band regions.

The choice of thread is crucial for the gusset construction. It has been found that bonded nylon thread offers greater strength compared to other conventional thread types such as cotton or cotton-polyester blends. In one embodiment, the thread consists of bonded nylon synthetic thread, typically Tex 70 weight, where 1,000 meters of thread weighs 70 grams, and it has an approximate breaking strength of 12 pounds with 30-40% stretch before failure.

The thread used in this construction comprised: Tex 70 V69, polyamide 6.6 bonded continuous filament. The designation "6.6" refers to its composition, which includes 6 carbon atoms, hexamethylenediamine, and adipic acid. The term "Tex" indicates the weight in grams per 1000 meters of thread, and Tex 70 corresponds to ticket number 70. For example, a Ticket number 69 polyester thread is made of 3 plies of 220 Denier, which totals 660 Denier. Accounting for a 5% twist contraction, the total Denier becomes 693. The term "V69" represents (3-plies×210 denier)+(5% for twist contraction)=662 denier. In this context, "denier" denotes the weight in grams of 9000 meters of thread.

Stitch Pattern: A zig-zag stitch, approximately 0.20 inches (approximately 5 mm) in width, with 10-12 stitches per inch (2.54 cm). The zig-zag stitch is preferred in one embodiment because it provides more stitching per square inch than a conventional straight lockstitch. This increased density of stitches allows the thread to stretch, absorb, and distribute significantly more force and stress than a conventional straight lockstitch.

Figure 13:
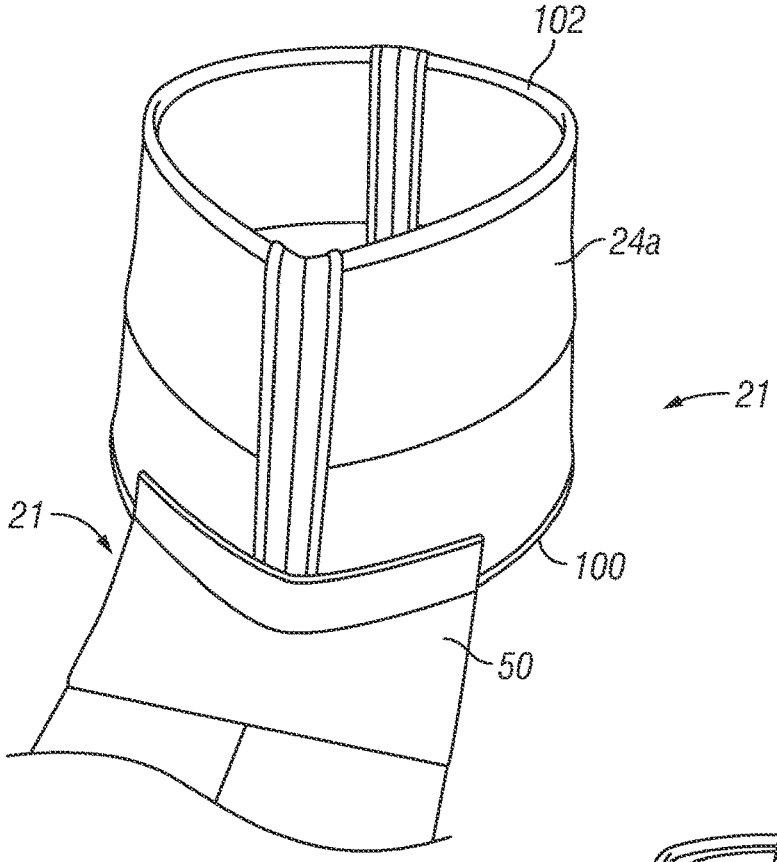
FIG. 13 illustrates an alternate view of the angled tapered arm cuff and gusset, according to various embodiments of the present disclosure.
Figure 14:
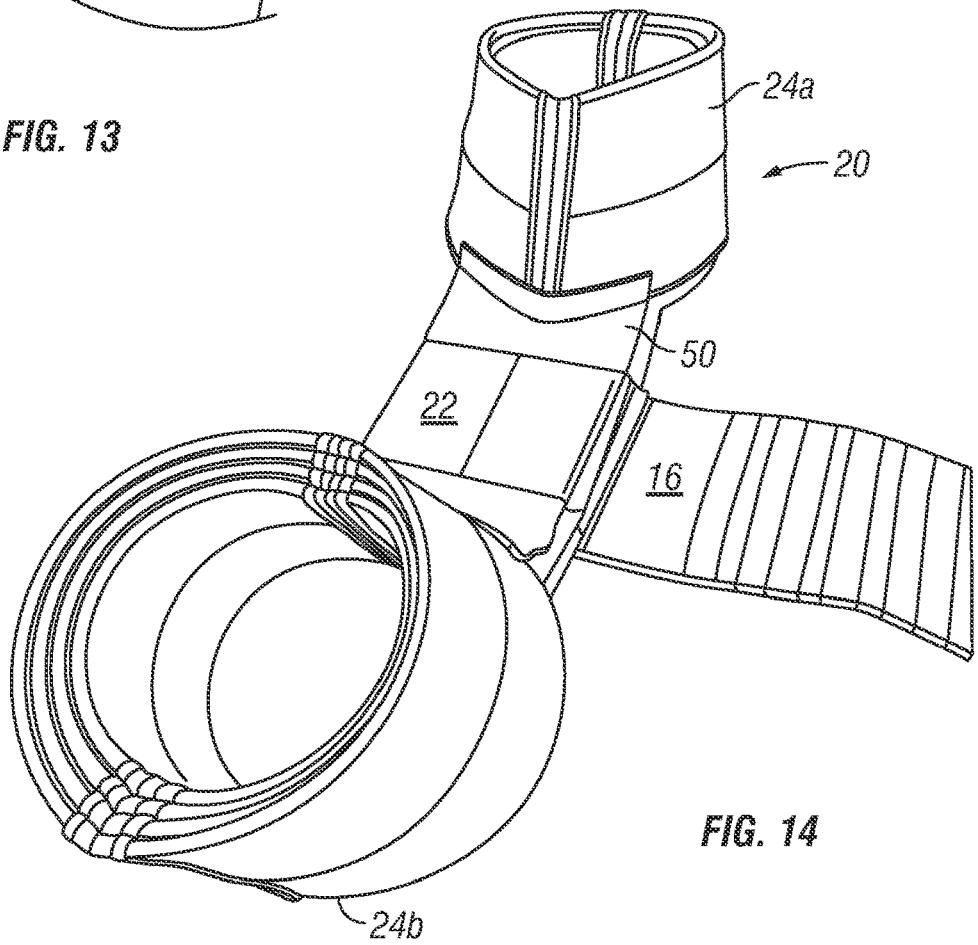
FIG. 14 illustrates a 4 ply device of the angled tapered arm cuff with a base unit showing the abdomen panel according to various embodiments of the present disclosure.

FIGS. 13 and 14 illustrate another exemplary embodiment directed to the construction of a base unit 21 using gusset 50. Like gussets 30 and 32, the two gussets, 50 and 52 (not shown in FIG. 14), are employed, attaching them to a base chest band 22. However, gussets 50 and 52 differ from gussets 30 and 32 in that they are angled or shaped to match a base end of the right arm cuff 28*a*. FIGS. 13 and 14 provide an enlarged view of an arm cuff construct 24, outlining base end 100 and outer end 102. It is to be noted that the base ends of the arm cuffs are longer than the outer ends of the arm cuffs. As shown, the outer end 102 of arm cuffs and the base end 100 of arm cuffs is angled or tapered. In one embodiment, the base end 102 of arm cuffs makes an angle of 70 degrees with the chest panel 22.

As seen in FIGS. 1 and 14, the abdomen band 16 is centered on the base chest band and oriented perpendicular to the chest band. It is securely fastened with a butt stitch where the chest and abdomen panel are adjoined against each other, side by side. A stitch is then sewn down the length of the adjoining pieces. This stitch covers both pieces. It is then reinforced with an elastic tape that covers the butt stitching as well as a portion of both the chest and abdominal panels. This is stitched with at least 3 stitches to assure a secure attachment. The abdomen band 16 is constructed from a fabric similar to the one used for the base chest band 12 and is sewn onto the base chest band 12 in the same manner as the base arm cuffs 14*a* and 14*b*. An alternative construction employs the use of 14 oz/yd warp knit polyester and a further alternate construction employs a gusset between the chest band and the abdomen panel, construction as discussed herein for the gusset and arm cuffs.

Similarly, the modular elastic support device 20 may include an optional abdomen band centered on the base chest band 22 and secured by similar means as device 10.

The abdomen band, such as 16 in FIG. 1, may comprise a third elastic sheet. In this context, the term "third rubber or elastic sheet" corresponds to a composite structure as described previously and may include a fabric. The third elastic sheet is constructed similarly to the first elastic sheet and/or the second elastic sheet, as described earlier. The third elastic sheet may be made from a single composite structure, or from multiple composite structures that are joined together to form the third elastic sheet. The abdomen band 16 covers an abdomen area of the user and hence a dimension of the abdomen band 16 will vary with the user. In one embodiment, 3" pieces of the composite structure are joined together and the number of pieces may vary from 5 to 7. The abdomen band 16 is attached to the chest panel using a butt seam construction with additional reinforcement. The reinforcement consists of a 0.75-inch knit elastic that is sewn over the butted seams. The butted end is vulnerable to joint failure. The reinforcement enhances strength while still allowing the base chest band 12, 22 to stretch and store energy.

Figure 16A:
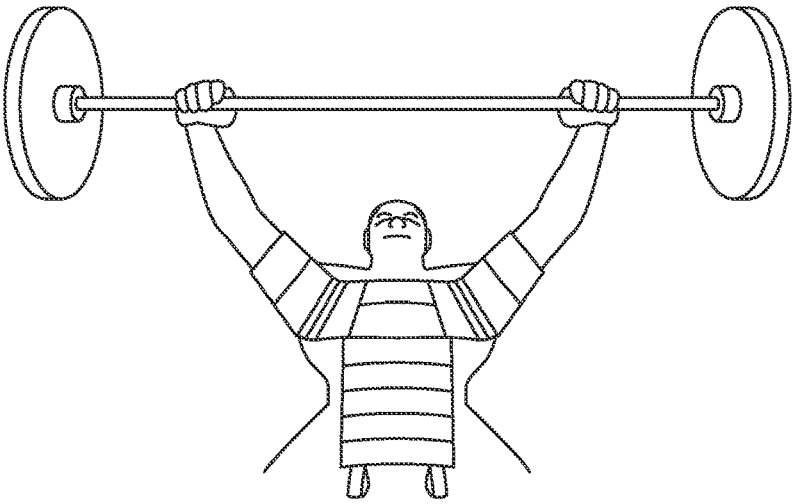
FIG. 16A, B, C illustrates an anatomical picture of the bend of the device in use.
Figure 16B:
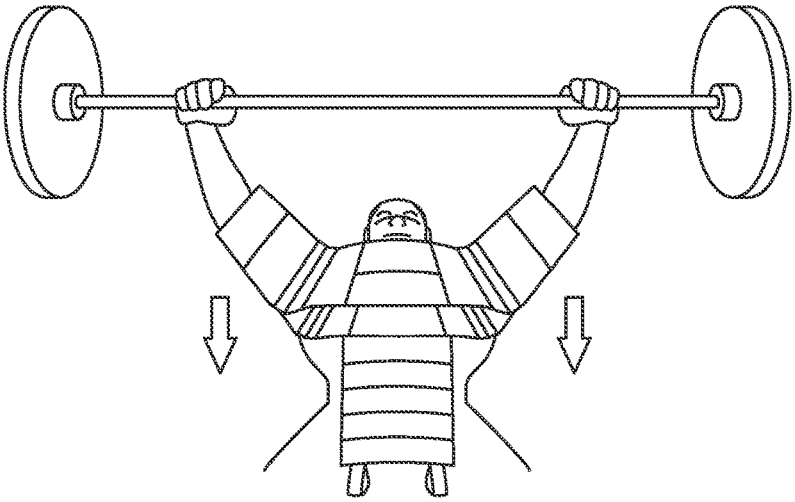
Figure 16C:
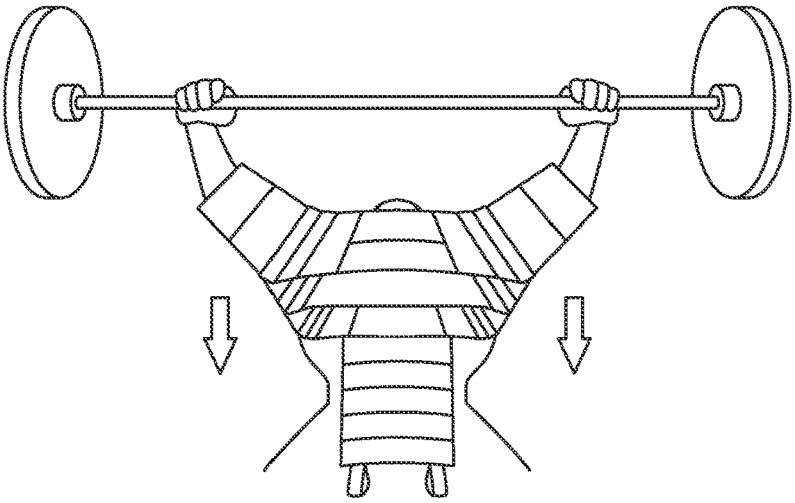

Along the lower edge of the abdomen band 16, at least one handle or loop 40 (a, b) may be sewn, allowing a spotter to adjust the location of the base chest band 12 and abdomen panel 16 on the user's chest and abdomen area, as depicted in FIG. 16. The abdomen band or panel 16 plays a role in securing the support device to the lifter by means of a belt that fastens over the abdomen band 16, in one embodiment. If the user wears any clothing over the device 10, the belt serves to secure the clothing item. Use of a belt is optional and at the discretion of the user.

Loops 40*a* and 40*b* are sewn in a manner similar to the attachment of the abdomen band 16 to the base chest band 12. These loops, 40*a* and 40*b*, assist in pulling the unit down into place once the lifter is wearing the complete device or setup. The complete setup may involve the base unit and modular units to form the complete elastic support device 10 or 20 along with an optional stretch shirt 60, which may or may not have built-in (sewn-in) Velcro in the back for closing the shirt during use. The stretch shirt goes over and covers the modular elastic support device 10, or 20. For added power, a stronger, less stretchy material can be used in constructing the shirt. Additionally, a traditional weight-lifting belt may be worn over the modular elastic support device 10, 20 and shirt 60 assembly before the lifter begins lifting weights. Throughout this process, the modular elastic support devices 10 and 20 are always kept away from the user's head.

Figure 4:
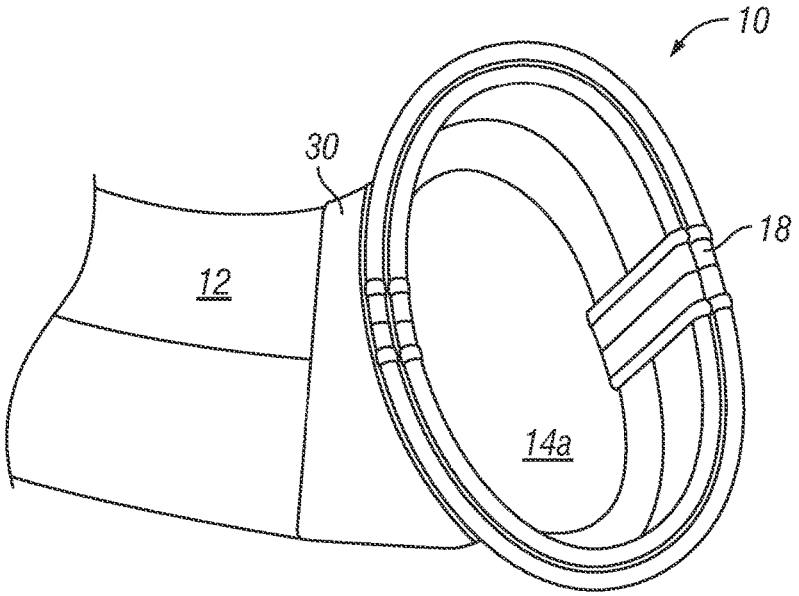
FIG. 4 illustrates stacking of a modular unit over the base unit to form a 2 ply device, showing the seams aligned, according to various embodiments of the present disclosure.
Figure 5:
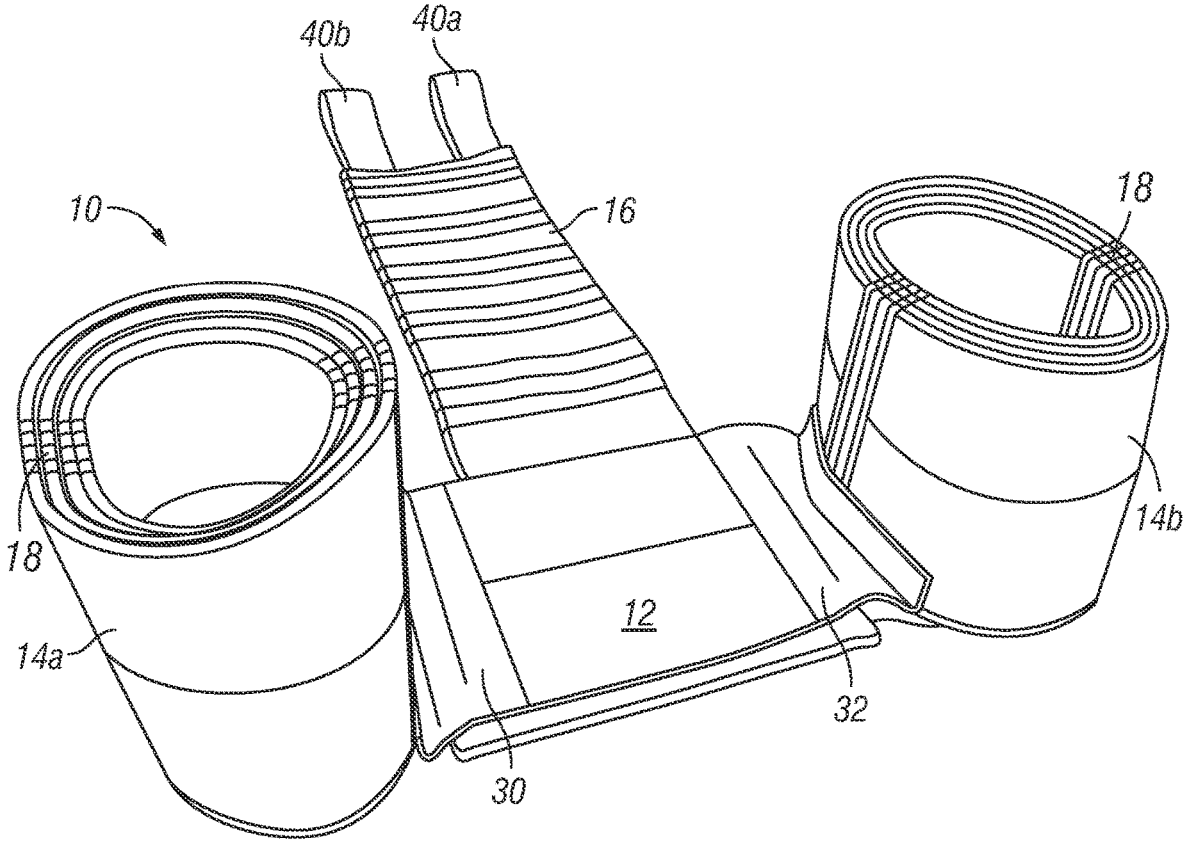
FIG. 5 illustrates stacking of a modular unit over the base unit of FIG. 1, to form a 4-ply device according to various embodiments of the present disclosure.

FIGS. 4 and 5 illustrates the placement of a single modular unit over the base unit 11, aligning the base arm cuffs 14 (a, b) properly when overlaying the modular unit to form the modular elastic support device 10. Prior to placing the modular elastic support device 10 on the user, the user will align the seams 18 of the base arm cuffs 14*a* and 14*b*, then slide the arm cuffs of the modular unit over the base unit 11, repeating this process for each additional modular unit, ensuring that the seams 18 are kept aligned. Each succeeding modular unit is slightly larger than the preceding unit, allowing the arm cuffs to fit snugly against each other when combined for use.

FIG. 5 illustrates a top view of the device 10 with the base unit and three modular units (4-ply or 4-layer device). FIG. 14 showcases the device 20 with the base unit and three modular units (4-ply or 4-layer device), with the seams 18 properly lined up for assembly and fit.

In cases where the user employs a base unit and a single modular unit, the device may feature an abdomen band (such as 16 of FIG. 1). However, for a modular elastic support device with more than two modular units, the abdomen band may not be necessary, and it is at the user's discretion to employ the additional abdomen panel.

Figure 7:
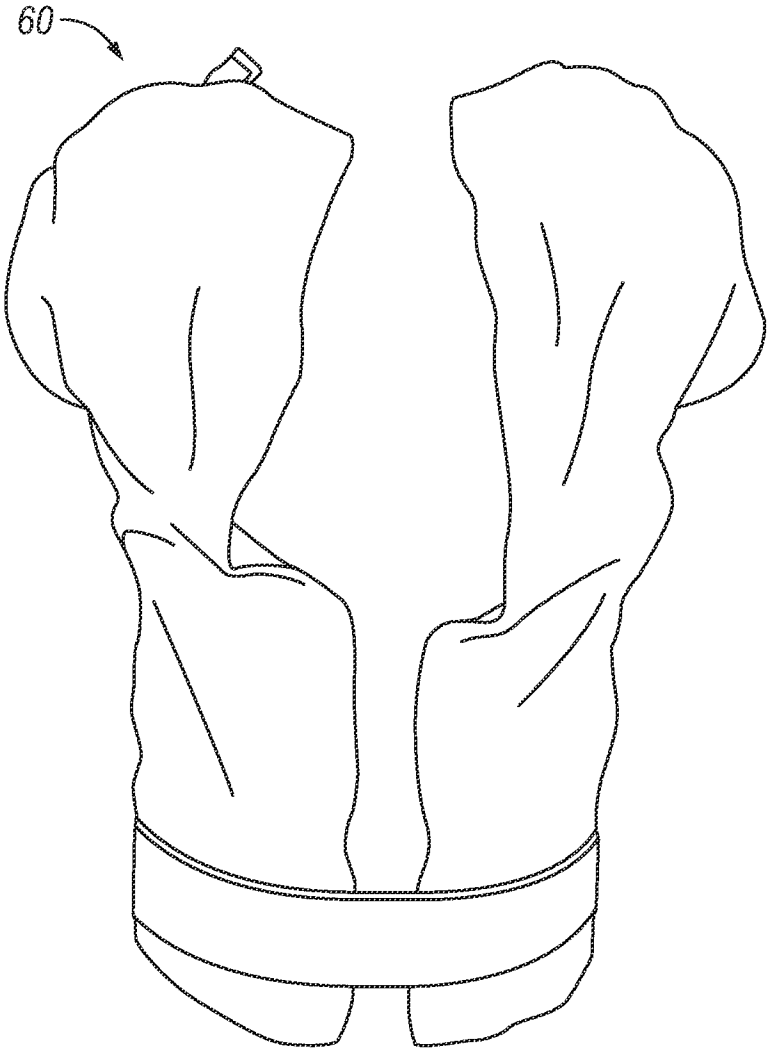
FIG. 7 illustrates a back closed view of the shirt with a belt, according to various embodiments of the present disclosure.
Figure 6:
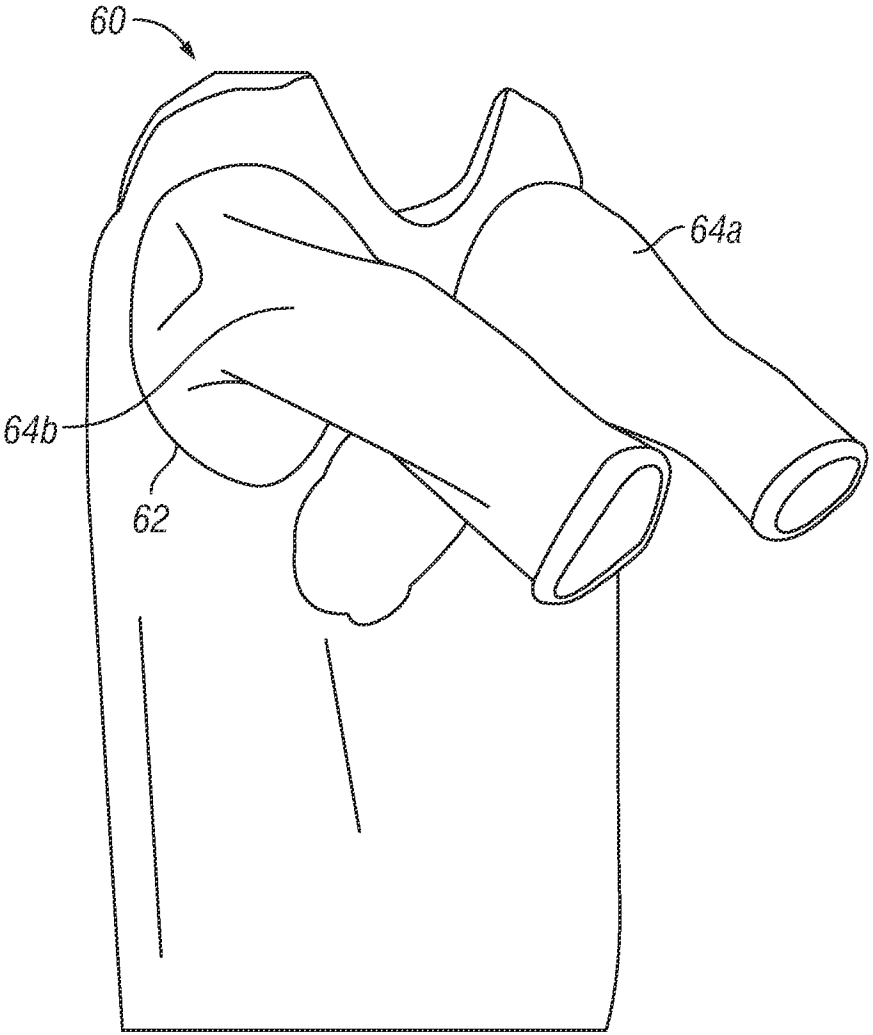
FIG. 6 illustrates a side view of the compression shirt, according to various embodiments of the present disclosure.
Figure 8:
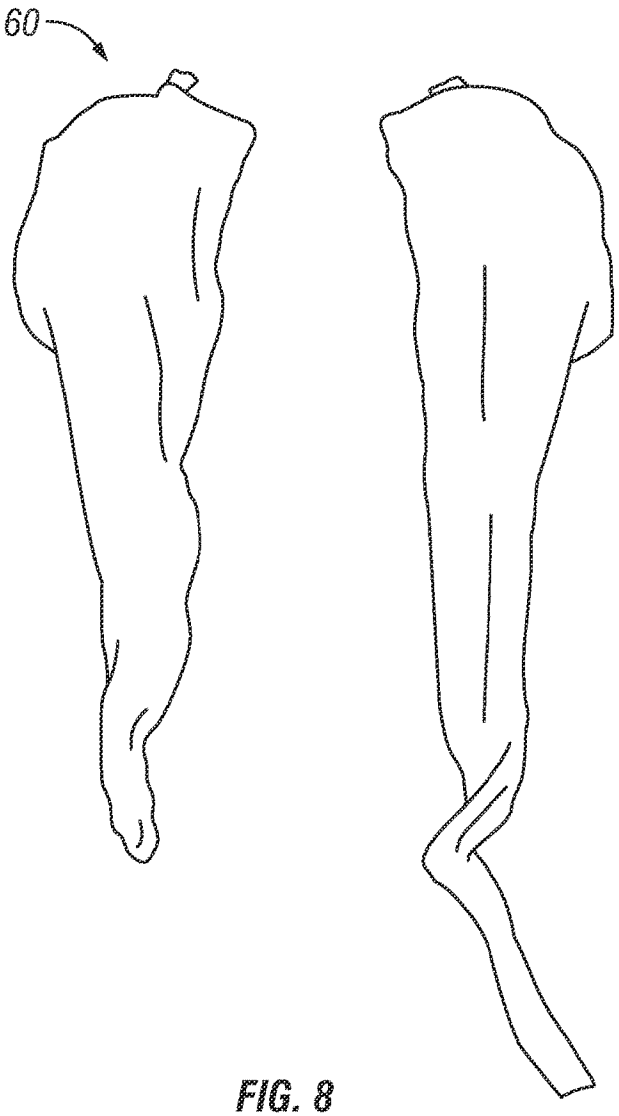
FIG. 8 illustrates a back open view of the shirt, according to various embodiments of the present disclosure.
Figure 11:
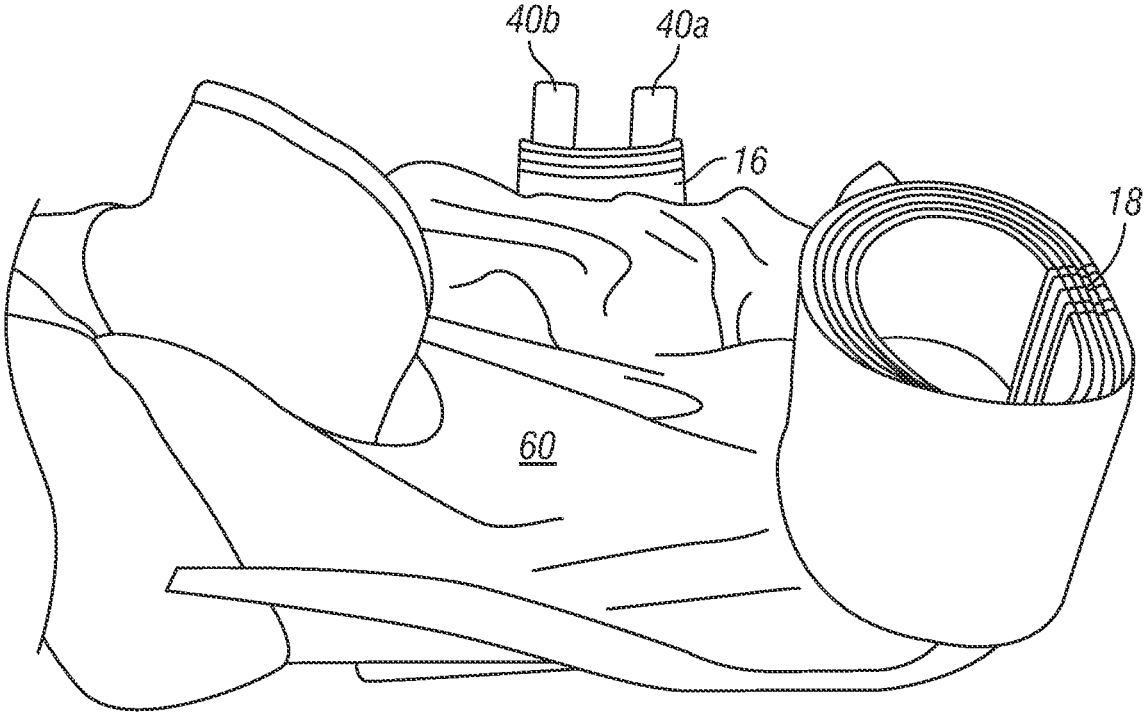
FIG. 11 illustrates a shirt being placed over the device, according to various embodiments of the present disclosure.
Figure 12:
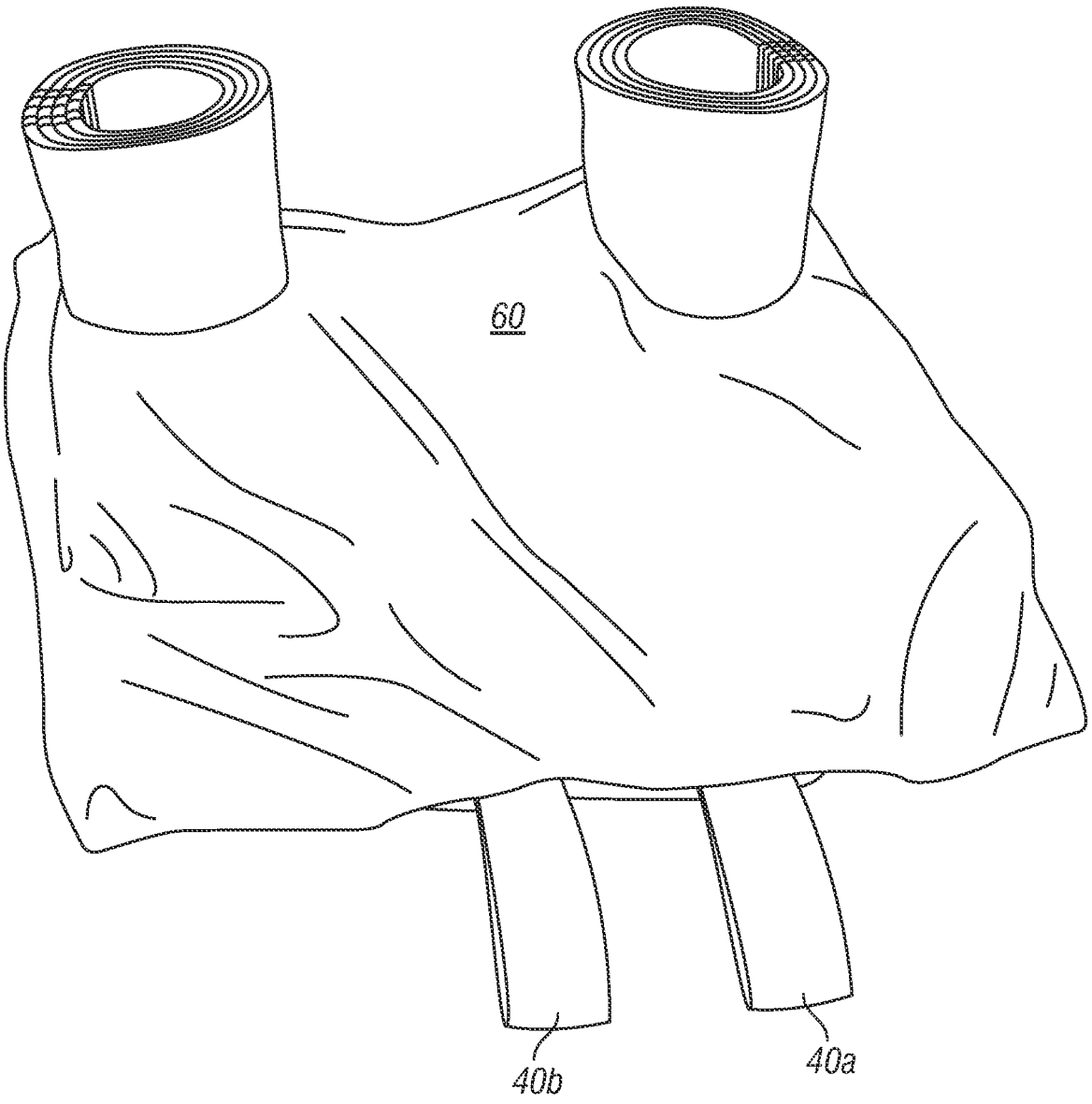
FIG. 12 illustrates the shirt being placed over the chest/abdomen area of the user, according to various embodiments of the present disclosure.

FIGS. 11 and 12 depict a shirt 60 that may cover devices 10 or 20. FIG. 6 displays the compression power shirt 60, and offers a side view of the shirt 60 with sleeves 64 (a, b) extended at approximately 90 degrees. FIG. 7 reveals the back view of the power shirt 60, closed, with a belt, while FIG. 8 shows the back of the shirt 60 in an open position.

The chest bands 12, 22 of the devices 10, or 20, respectively are stronger than the fabric of the shirt of the same width and thickness by a factor of at least three, preferably by a factor of at least five or more. The chest band 12, 22 may be capable of supporting at least two hundred pounds, and may preferably be capable of supporting at least four hundred pounds or more.

When the shirt 60 is combined with device 10 or 20 to form an arrangement as shown in FIG. 12, it offers support for lifting weights of up to and greater than approximately 1,000 lbs.

The shirt 60 incorporates relatively weak fabric compared to the fabric and/or elastic material of the first, second, and third rubber or elastic sheets used in the modular elastic support device 10, or 20. The shirt 60 can be manufactured in two versions: a passive version and a supportive version. In the passive version, the shirt 60 may consist of stretchy fabric with no support and may be worn solely for aesthetics. In the supportive version, the shirt 60 is made of a synthetic material designed and constructed to provide more energy storage than the compressive force generated by device 10, or 20 alone.

In one embodiment, during use, the shirt is slid over device 10 or 20. A supportive shirt is sturdier than a passive shirt and can be used to enhance the performance of a weightlifter, although not to the same extent as the device 10, or 20. The shirt, when combined with device 10, or 20, is an additional feature that enhances the device's functionality. The shirt 60 can be used for weightlifting but is not recommended for other types of exercises such as push-ups.

Alternatively, the core or interior of a supportive shirt can have sleeve panels for the shirt before they are sewn together. The shirt 60 includes sleeves 64*a*, 64*b* separated from the torso section. Sleeves 64 (a, b) extend around armholes where seam 62 is seen in FIG. 6, and the sleeves 64 (a, b) project forwardly like a traditional lifter's shirt. As shown, the shirt 60 also includes a fabric collar providing a neck hole. While the shirt can be made from various materials or fabrics, it is not recommended for the shirt 60 to be made of an elastic material, primarily from an aesthetics point of view. The shirt 60 may be made from fabric to provide a conventional appearance when used with device 10, or 20. Additionally, at least one weightlifting federation mandates that band shirts retain the look of a more conventional bench press shirt.

FIGS. 11 and 12 demonstrate the process of placing the inventive shirt over the device to form the arrangement of device 10 or 20. First, the shirt is positioned over the arm cuffs and then stretched over the chest band. Subsequently, the power lifter or user will put the entire assembly of device and the shirt, on their body. An open-back shirt (FIG. 8) has been found to be easier to put on compared to a traditional shirt that requires the user to put it over their head along with device 10, or 20. Essentially, device 10, or 20 is inserted into shirt 60 and then placed on the lifter for use.

FIG. 12 shows the inventive shirt placed over the device, with the loops 40*a* and 40*b* at the bottom of the abdomen area exposed. It can be observed that the arm cuffs are at approximately a 90-degree angle relative to the shirt.

The shirt 60 can be made from any suitable material with the characteristic of not excessively gripping underlying apparel that the user may be wearing. Typically, the fabric is composed of natural or synthetic fibers or a blend of both and is sufficiently elastic to allow at least some stretching.

The construction of the shirt 60 will vary depending on the desired outcome. If the goal is to simply provide a cover for device 10, or 20, then the shirt can be of lighter construction. This might involve a stretch-type fabric such as spandex and serged seams. However, if additional support is the goal, then the construction will be much heavier. Supportive fabrics will be of the type described previously. Seams will be sewn with a tight zig-zag stitching and then tacked down for added strength, creating a heavy, double-stitched seam. The neck will be wide and heavily constructed, typically being 5 plies thick and 1.5 inches wide. There are no special inserts. Additionally, if even more power is desired, a torque seam sleeve can be added, as disclosed in U.S. Pat. No. 8,578,517, which is incorporated herein by reference.

FIG. 16 illustrates the elastic device in use showing up to 3 layers. Additional layers can be added per the disclosure herein. Layer 1 features an abdomen panel with loops attached to the bottom. As is seen in the illustration, as the user lowers the weight bar, the dynamics of the device are in use showing muscular resistance in the user and the device loading or storing energy.

As disclosed above, the present invention is an improvement over that of U.S. Pat. Nos. 10,363,452 and 10,953,276. In summary, modular elastic support device comprises a first and second arm cuffs configured to respectively encircle an upper portion of a user's left and right arms; and a central elastic member of generally rectangular shape, the first and second arm cuffs being attached to opposite ends in a longitudinal direction of the central elastic member, the central elastic member having a length sufficient to extend across a chest of the user, the central elastic member comprising a rubber sheet having a width, length and thickness where the width and length are at least ten times the thickness; wherein the rubber sheet is expansible in a first direction between the first and second arm cuffs and expansible in a second direction perpendicular to the first direction, expansibility of the rubber sheet in the first direction being substantially equal to expansibility of the rubber sheet in the second direction, to form an initial support device, wherein the improvement comprises at least one additional support device constructed of elastic members wherein the arm cuffs of the additional support device are slightly larger to stack over the initial support device and provide for a zero gap between arm cuffs to form a modular elastic support device which can transfer energy between arm cuffs to the user during a weightlifting exercise. The central elastic members and an optional abdomen area member comprise an outside and an inside, the inside configured to juxtapose a user's chest, and the modular elastic support device further comprising a rubber sheet having a width, length, and thickness where the width and length are at least ten times the thickness.

Device in Use

Before using device 10 or 20, the lifter can determine the number of layers required for the assembly. Once the user overlays a modular unit over the base unit, the assembly is ready for use either as is or with a shirt 60.

The decision to wear the optional shirt 60 over device 10 or 20 is left to the user. If the lifter prefers not to wear a shirt over device 10 or 20, they will assemble the desired number of layers to complete device 10 or 20. The number of layers will depend on the lifter's desired strength and energy storage for their lifting exercise. The loops 40*a* and 40*b* can be used to pull the unit down into place and are typically pulled by a spotter once device 10 is placed on the lifter. The lifter may also have a belt secured over device 10 or 20.

If desired, the lifter or user can opt for a complete setup, which includes device 10 or 20 plus shirt 60. The shirt preferably has an opening in the back with a Velcro or other closing mechanism to secure the back of the shirt. The closing mechanism is not shown in FIGS. 7 and 8. A powerlifting belt is then secured around the wearer's waist, over shirt 60, to hold down the abdomen band 16 and the shirt 60.

If a user desires a shirt, it can be made of various power storage materials. For example, for additional power, a stronger, less stretchy material can be used in the shirt, as disclosed in U.S. Pat. No. 8,578,517, which is incorporated herein by reference.

The device will function without a powerlifting belt; however, the belt optimizes positioning for maximum power and helps prevent the shirt from slipping out of place. The combination of device 10 or 20 plus power shirt 60 allows for an additional dimension of power adjustment separate from device 10 or 20 alone. The position of device 10 or 20 on the user impacts weightlifting performance; for instance, allowing device 10 or 20 to ride higher on the lifter's chest provides less energy storage/power, which is functional for lighter weight attempts where too much power can adversely affect lifting technique. Pulling shirt 60 down on the chest and securing it in place with a belt creates more energy storage and power for heavier weight attempts.

A user can place an unlimited number of modular units to complete device 10 or 20. Three to five (3-5) layers are generally sufficient for maximum strength and energy storage for use in weightlifting. However, the modular design allows for more layers if desired. While more layers increase the bulkiness of the device for the user, it is believed that around 7-9 layers achieve even more energy storage and dissipation for the power lifter. Although the device 10 or 20 is described with specific materials, it is possible that thicker elastic sheets could be manufactured to provide a 1-ply device with equivalent thickness to a 3-ply or 5-ply device, or other desired layering. However, at present, there is no known textile technology capable of creating such thick elastic or rubber material with sufficient elastic strength and stretch to make device 10 or 20. As the material becomes thicker, alternative technologies must be considered for sewing seams and piecing the device together while maintaining sufficient strength to support weightlifting loads, possibly exceeding one thousand pounds. Alternatively, thinner fabric could be used, allowing weightlifters to use more layers together. The lifter decides the number of layers to use based on the weight they intend to lift. For example, larger lifters may want to use or more layers. Superheavy world-class lifters can have bodyweights ranging from 330 lbs. to 420 lbs. and may have the mass to allow for the use of these many layers (e.g., 10+ plies). Device 10 or 20 can have a thickness in the range of about 1.96 millimeters (mm) to about 10 mm, with a preference for a range of about 4.5 mm to about 5 mm.

Regarding shirt 60, the friction generated by movement against clothing can vary unpredictably due to the wide variety of commercial shirts worn by lifters, athletes, and general fitness enthusiasts. Elasticity and friction properties of shirts can differ widely because of variations in the content of natural and synthetic fibers, as well as pattern designs or ink used on graphics in different commercial brands. When lifting heavy or maximum weights, achieving smooth and efficient form or technique is critical. Any inconsistencies or jerky movements in a lift can lead to a loss of form or technique, resulting in failed lifts or potential injuries to the lifter or user. The construction of both the device and the shirt, as disclosed, ensures that the device 10 works efficiently with the user, regardless of what the user is wearing, whether it's a shirt or being bare-chested.

While device 10 or 20 is primarily discussed in the context of lifting weights, it is also useful for other exercises like push-ups, bench press repetitions, or exercises involving rearward arm movement. The shirt alone is not recommended for use alone for non-weightlifting exercises. The user's arms are inserted into arm cuffs 14*a*, 14*b*, 24*a*, and 24*b*, which may cover the elbow and part of the upper arm. These exercises elongate chest band 12 or 22 and provide resistance to the user's arm movements. During bench pressing with shirt 60, a lifter lies on their back, typically on a bench, and grasps a barbell with both hands, lowering a weight toward the chest. Lowering the barbell in a bench press movement stretches chest band 12 or 22, storing energy in the device and the shirt 60. This stored energy is then available to assist the lifter in raising the barbell, thereby increasing the weight they can lift. FIG. 16 illustrates use of the device.

It is observed that the energy storage in the embodiments act to constrain the outward movement of arm cuffs 14*a*, 14*b*, 24*a* or 24*b*. As a result, the sleeves 64*a*, 64*b* of shirt 60 may be made of a material stronger than might be expected. In one embodiment, the sleeves are made of the same material as arm cuffs, or alternatively, of a strong fabric such as a one-ply synthetic polymer fabric of approximately 0.75 mm-1 mm thickness, about 15-35% of the strength of the rubber sheet. The sleeves are directly connected, through sewing or a similar method, to the front and back of shirt 60, as shown in FIG. 6. Optionally, a panel with sufficient strength to accommodate the forces involved may be built into shirt 60. The majority of the power used by a lifter comes from the elastic device 10 or 20.

EXAMPLES

The examples provided demonstrate the potential benefits of using the device without the inventive shirt. It is important to note that individual performance may vary due to factors such as the user's body composition, technique, and muscle strength.

Example 1, User 1

User 1 normally bench presses about 400 lbs. in a regular cotton t-shirt. (330 lb. bodyweight) Using a 3-ply prototype device, User 1 was able to bench press 625 lbs., with an estimated potential to reach 650 lbs.

This suggests that the prototype device provided an increase of approximately 225-250 lbs. in lifting capacity for User 1.

Example 2, User 2

User 2 typically bench presses about 215 lbs. in a regular cotton t-shirt at a bodyweight of 190 lbs.

When using a 1-ply prototype device, User 2 was able to bench press 335 lbs., representing an increase of approximately 120 lbs.

The increase in lifting capacity for both users demonstrate the effectiveness of the device 10. It's estimated that each layer, or additional modular unit, of the device can provide an additional 83 lbs. of force, although this can vary depending on individual factors.

While not directed towards a therapeutic device, the device 10 or 20, can assist lifters having prior injuries to continue weightlifting. It can serve as a preventive aid to avoid injuries when used in proper form. A user is cautioned to not perform any weightlifting acts without the authorization or recommendation of their physician.

The following illustrates exemplary measurements for the supportive device 20. Each successive modular unit must fit over the prior unit, with the arm cuffs slightly larger and the chest panel slightly smaller to accommodate the required snug fit of the cuffs and use by the user.

TABLE 2

Measurements of supportive device 20.

| | Base unit | Modular unit-1 | Modular unit-2 | Modular unit-3 | Modular unit-4 |
|---|---|---|---|---|---|
| Chest band | 8.5" | 8" | 7.5" | 7" | 6.5" |
| Base end of arm cuff | 18" | 19.25" | 20.5" | 21.75" | 23" |
| Outer end of arm cuff | 14" | 15.25" | 16.5" | 17.75" | 19" |

The device's impact on lifting capacity can vary from person to person, and other factors like proper technique and safety precautions should always be considered during weightlifting activities.

The present disclosure introduces several advantages over prior art devices for assisting in weight or powerlifting and other weight-bearing exercises involving the chest and arms. While not an exhaustive list, these advantages include:

Modular Design: The modular design allows users to quickly adjust the level of power or support as needed. This adaptability is beneficial for different lifting scenarios and individual preferences.

Thickness Parameters: The modular design allows for the construction of devices that can surpass the maximum thickness parameters of existing shirts or support garments. This means users can achieve higher levels of energy storage and support than with traditional garments.

Reduced Sewing Machine Limitations: The design minimizes the limitations imposed by sewing machine capabilities, as the construction primarily involves layering and connecting elastic components rather than sewing heavy, multi-ply fabrics. This reduces the risk of machine damage and the need for specialized sewing equipment (that may not exist).

Minimized Risk of Damage: Sewing multi-ply, heavy elastics can increase the risk of needle breakage and potential damage to sewing machinery. The present design reduces this risk, resulting in fewer equipment repairs and maintenance costs.

Simplified Manufacturing: The manufacturing process is simplified compared to traditional powerlifting garments. The modular components can be assembled more efficiently, potentially reducing production costs.

Improved Biomechanical Efficiency: The device's design enhances biomechanical efficiency during weightlifting exercises. It stores and releases energy effectively, assisting lifters in their movements.

Cost Savings: Users can avoid the need to purchase multiple shirts or support garments for different lifting scenarios. The modular design offers versatility and adaptability in a single device.

Overall, these advantages make the disclosed modular elastic support device a valuable tool for weightlifters and individuals engaging in chest and arm-centric exercises, providing both functional benefits and cost-effective solutions compared to existing alternatives.

The present disclosure has been described herein with reference to a particular embodiment for a particular application. Although selected embodiments have been illustrated and described in detail, it may be understood that various substitutions and alterations are possible. Those having an ordinary skill in the art and access to the present teachings may recognize additional various substitutions and alterations are also possible without departing from the spirit and scope of the present disclosure.

While various exemplary embodiments of the disclosed systems and methods have been described above, they have been presented for purposes of example only, and not limitations. It is not exhaustive and does not limit the disclosure to the precise form disclosed. Modifications and variations are possible considering the above teachings or may be acquired from practicing the disclosure, without departing from the breadth or scope.

In the claims, the words 'comprising', 'including', and 'having' do not exclude the presence of other elements or steps than those listed in a claim. The terms "a" or "an," as used herein, are defined as one or more than one. Unless stated otherwise, terms such as "top", "bottom", "right" and "left" are used to arbitrarily distinguish between the elements such terms describe. Thus, these terms are not necessarily intended to indicate temporal or other prioritization of such elements.

The invention claimed is:

1. A modular elastic support device for a user, comprising:

a base unit, comprising:

a base chest band comprising a first elastic sheet having a left side, a right side, a top side, and a bottom side;

a base left arm cuff and a base right arm cuff comprising a second elastic sheet, wherein the base left arm cuff and the base right arm cuff are secured substantially perpendicular to the base chest band by means of gussets provided on the left side and the right side of the base chest band, an abdomen band comprising a third elastic sheet, wherein the abdomen band is substantially perpendicular to the chest band, centered, and secured on the bottom side of the chest band;

at least one modular unit, comprising:

a modular chest band comprising the first elastic sheet having a left side, a right side, a top side, and a bottom side;

a modular left arm cuff and a modular right arm cuff comprising the second elastic sheet, wherein the modular left arm cuff and the modular right arm cuff are secured substantially perpendicular to the modular chest band by means of gussets provided on the left side and the right side of the modular chest band, wherein further the modular left arm cuff and the modular right arm cuff are slightly larger to nest or stack over the base unit arm cuffs respectively, providing essentially a zero gap between the base and modular unit arm cuffs to form the modular elastic support device.

2. The modular elastic support device of claim 1, wherein the modular unit includes greater than one (1) modular units.

3. The modular elastic support device of claim 1, wherein the modular unit comprises up to four (4) modular units.

4. The modular elastic support device of claim 3, wherein each succeeding modular unit is stacked over a preceding modular unit, and wherein arm cuffs of the succeeding modular unit are each slightly larger than arm cuffs of the preceding modular unit.

5. The modular elastic support device of claim 1, wherein energy is transferred between the modular unit and the base unit to the user to assist during a weightlifting exercise.

6. The modular elastic support device of claim 1, wherein the arm cuffs are at approximately a 90-degree angle relative to the chest band.

7. The modular elastic support device of claim 6, wherein the arm cuffs are circular in design.

8. The modular elastic support device of claim 1, wherein the arm cuffs are at approximately a 70-degree angle relative to the chest band, and said arm cuffs are tapered and angled.

9. The modular elastic support device of claim 1, wherein the gussets are crafted from a fabric stronger than the base arm cuffs, base chest band, and abdomen band.

10. The modular elastic support device of claim 9, wherein the gussets are crafted from 14 oz warp knit polyester fabric.

11. The modular elastic support device of claim 1, for use by the user during a weightlifting exercise.

12. The modular elastic support device of claim 11, further worn together with a power shirt.

13. The modular elastic support device of claim 12, wherein energy is transferred between the modular elastic support device and the shirt to the user to assist during a weightlifting exercise.

14. A modular elastic support device comprising:

first and second arm cuffs configured to respectively encircle an upper portion of a user's left and right arms; and a central elastic member of generally rectangular shape, the first and second arm cuffs being attached to opposite ends in a longitudinal direction of the central elastic member, the central elastic member having a length sufficient to extend across a chest of the user, the central elastic member comprising a rubber sheet having a width, length and thickness where the width and length are at least ten times the thickness;

wherein the rubber sheet is expansible in a first direction between the first and second arm cuffs and expansible in a second direction perpendicular to the first direction, expansibility of the rubber sheet in the first direction being substantially equal to expansibility of the rubber sheet in the second direction, to form an additional elastic member situated perpendicular to the central elastic member and is configured to lie across the user's abdomen area, as an initial support device, and further comprising, at least one additional support device constructed of elastic members above without an abdomen area member perpendicular to the central elastic member, wherein the arm cuffs of the additional support device are slightly larger to stack over the initial support device and provide for a zero gap between arm cuffs to form a modular elastic support device which is configured to transfer energy between arm cuffs to the user during a weightlifting exercise.

15. The modular elastic support device of claim 14, wherein the central elastic members and the abdomen area member comprise an outside and an inside, the inside configured to juxtapose the user's chest.

16. The modular elastic support device of claim 14 comprising up to four (4) additional support devices.

* * * * *